US008353369B2

(12) United States Patent
Rainey et al.

(10) Patent No.: US 8,353,369 B2
(45) Date of Patent: Jan. 15, 2013

(54) PERCUSSION ASSISTED ROTARY EARTH BIT AND METHOD OF OPERATING THE SAME

(75) Inventors: Allan W. Rainey, Mansfield, TX (US); James W. Langford, Granbury, TX (US)

(73) Assignee: Atlas Copco Secoroc, LLC, Grand Prairie, TX (US)

( * ) Notice: Subject to any disclaimer, the term of this patent is extended or adjusted under 35 U.S.C. 154(b) by 647 days.

(21) Appl. No.: 12/536,424

(22) Filed: Aug. 5, 2009

(65) Prior Publication Data

US 2010/0032209 A1 Feb. 11, 2010

Related U.S. Application Data

(60) Provisional application No. 61/086,740, filed on Aug. 6, 2008.

(51) Int. Cl.
*E21B 10/36* (2006.01)
*E21B 10/42* (2006.01)

(52) U.S. Cl. ..... 175/415; 175/296

(58) Field of Classification Search ..... 175/293, 175/296, 415; 173/206, 207, 138
See application file for complete search history.

(56) References Cited

U.S. PATENT DOCUMENTS

| | | | |
|---|---|---|---|
| 1,010,143 | A | 11/1911 | Hughes |
| 1,238,407 | A | 8/1917 | Hughes |
| 1,494,274 | A | 5/1924 | Morgan |
| 1,816,549 | A | 7/1931 | Carleton |
| 1,885,085 | A | 10/1932 | Dalzen |
| RE19,339 | E | 10/1934 | Vertson |
| 2,025,260 | A | 12/1935 | Zublin |
| 2,048,072 | A | 7/1936 | Johansen |
| 2,177,332 | A | 10/1939 | Reed |
| 2,230,569 | A | 2/1941 | Howard et al. |
| 2,272,650 | A | 2/1942 | Von Veh Ernst |
| 2,528,300 | A | 10/1950 | Degner |
| 2,539,584 | A | 1/1951 | Maier |
| 2,634,955 | A | 4/1953 | Johnson |
| 2,663,546 | A | 12/1953 | Kammerer |
| 2,737,839 | A | 3/1956 | Paget |
| 2,756,966 | A | 7/1956 | Bassinger |

(Continued)

FOREIGN PATENT DOCUMENTS

WO 93/06334 A1 4/1993

(Continued)

OTHER PUBLICATIONS

V.I. Vasil'Chenko, "Drilling and Blasting Operations in Power Construction", All-Union Planning, Construction, and Installation Association Soyuzgidrospetsstroi, pp. 749-755, 1992 Plenum Publishing Corporation.

(Continued)

*Primary Examiner* — Daniel P Stephenson
(74) *Attorney, Agent, or Firm* — Schmeiser, Olsen & Watts LLP

(57) ABSTRACT

A method of boring through a formation includes providing a drilling machine and drill string and operatively coupling an earth bit to the drilling machine through the drill string. An air flow is provided through the drill string at an air pressure less than about one-hundred pounds per square inch (100 psi) and an overstrike force is applied to the earth bit, wherein the overstrike force is less than about five foot-pounds per square inch (5 ft-lb/in$^2$).

19 Claims, 14 Drawing Sheets

U.S. PATENT DOCUMENTS

| | | | |
|---|---|---|---|
| 2,787,502 | A | 4/1957 | Huchshold |
| 2,916,122 | A | 12/1959 | Hindmarch |
| 2,942,579 | A | 6/1960 | Morrison |
| 2,947,519 | A | 8/1960 | Feucht |
| 2,966,221 | A | 12/1960 | Kinney |
| 2,979,176 | A | 4/1961 | Voth |
| 2,985,472 | A | 5/1961 | Schoenrock |
| 3,106,999 | A | 10/1963 | Snoy |
| 3,129,963 | A | 4/1964 | Robbins |
| 3,142,345 | A | 7/1964 | Hawthorne et al. |
| 3,193,028 | A | 7/1965 | Radzimovsky |
| 3,195,695 | A | 7/1965 | McIntyre |
| 3,245,180 | A | 4/1966 | Bules et al. |
| 3,250,337 | A | 5/1966 | Demo |
| 3,250,540 | A | 5/1966 | Christensen et al. |
| 3,259,403 | A | 7/1966 | Hjalsten et al. |
| 3,265,175 | A | 8/1966 | Croswhite |
| 3,302,983 | A | 2/1967 | Garrett |
| 3,307,641 | A | 3/1967 | Wiggins, Jr. |
| 3,336,992 | A | 8/1967 | White |
| 3,361,219 | A | 1/1968 | Sears |
| 3,401,759 | A | 9/1968 | White |
| 3,410,353 | A | 11/1968 | Martini |
| 3,413,045 | A | 11/1968 | Wohfeld |
| 3,444,939 | A | 5/1969 | Bechem |
| 3,463,247 | A | 8/1969 | Klein |
| 3,472,350 | A | 10/1969 | Overson |
| 3,485,301 | A | 12/1969 | Stewart |
| 3,489,421 | A | 1/1970 | Neilson |
| 3,527,239 | A | 9/1970 | Boom |
| 3,529,840 | A | 9/1970 | Kupfert et al. |
| 3,550,972 | A | 12/1970 | Coski et al. |
| 3,561,616 | A | 2/1971 | Eddy et al. |
| 3,572,853 | A | 3/1971 | Coski |
| 3,622,124 | A | 11/1971 | Sidles et al. |
| 3,670,831 | A | 6/1972 | Winter, Jr. et al. |
| 3,692,123 | A | 9/1972 | Gyongyosi |
| 3,695,363 | A | 10/1972 | Kelly, Jr. |
| 3,708,024 | A | 1/1973 | Back |
| 3,768,576 | A | 10/1973 | Martini |
| 3,771,389 | A | 11/1973 | Coyne |
| 3,775,819 | A | 12/1973 | Ribich |
| 3,778,940 | A | 12/1973 | Blecken |
| 3,805,902 | A | 4/1974 | Storm et al. |
| 3,807,512 | A | 4/1974 | Pogonowski et al. |
| 3,815,690 | A | 6/1974 | Cooper |
| 3,823,902 | A | 7/1974 | Bumueller |
| 3,833,072 | A | 9/1974 | Back |
| 3,847,235 | A | 11/1974 | Goodfellow |
| 3,905,168 | A | 9/1975 | Nelmark et al. |
| 3,961,440 | A | 6/1976 | Saito |
| 3,963,282 | A | 6/1976 | Penny |
| 3,964,551 | A | 6/1976 | Bassinger |
| 3,968,845 | A | 7/1976 | Chaffin |
| 3,970,152 | A | 7/1976 | Harris et al. |
| 3,992,831 | A | 11/1976 | Bukovitz et al. |
| 3,998,500 | A | 12/1976 | Dixon |
| 4,003,442 | A | 1/1977 | Bassinger |
| 4,016,687 | A | 4/1977 | Griffith et al. |
| 4,020,909 | A | 5/1977 | Airaudo |
| 4,022,410 | A | 5/1977 | Ewart et al. |
| 4,030,542 | A | 6/1977 | Poe et al. |
| 4,030,554 | A | 6/1977 | Kammerer, Jr. et al. |
| 4,040,493 | A | 8/1977 | Saxman |
| 4,052,135 | A | 10/1977 | Shoop et al. |
| 4,054,180 | A | 10/1977 | Bassinger |
| 4,067,405 | A | 1/1978 | Bassinger |
| 4,100,976 | A | 7/1978 | Stone |
| 4,106,578 | A | 8/1978 | Beyer |
| 4,136,748 | A | 1/1979 | Dickerhoff |
| 4,145,094 | A | 3/1979 | Vezirian |
| 4,160,680 | A | 7/1979 | Novy et al. |
| 4,161,225 | A | 7/1979 | Mitchell |
| 4,167,980 | A | 9/1979 | Saxman |
| 4,170,340 | A | 10/1979 | Mouton, Jr. |
| 4,171,025 | A | 10/1979 | Bassinger |
| 4,179,003 | A | 12/1979 | Cooper et al. |
| 4,246,809 | A | 1/1981 | Keast et al. |
| 4,256,193 | A | 3/1981 | Kunkel et al. |
| 4,277,109 | A | 7/1981 | Crow |
| 4,278,135 | A | 7/1981 | Currington |
| 4,279,850 | A | 7/1981 | Lynch |
| 4,295,758 | A | 10/1981 | Yashima |
| 4,303,137 | A | 12/1981 | Fischer |
| 4,303,138 | A | 12/1981 | Bassinger |
| 4,306,727 | A | 12/1981 | Deane |
| 4,320,808 | A | 3/1982 | Garrett |
| 4,333,537 | A | 6/1982 | Harris et al. |
| 4,359,114 | A | 11/1982 | Miller et al. |
| 4,380,347 | A | 4/1983 | Sable |
| 4,393,949 | A | 7/1983 | Peterson |
| 4,427,307 | A | 1/1984 | Norlander et al. |
| 4,448,268 | A | 5/1984 | Fuller |
| 4,456,811 | A | 6/1984 | Hella et al. |
| 4,466,622 | A | 8/1984 | Deane et al. |
| 4,478,291 | A | 10/1984 | Futros |
| 4,487,229 | A | 12/1984 | Dreyfuss et al. |
| 4,492,666 | A | 1/1985 | Dreyfuss et al. |
| 4,494,749 | A | 1/1985 | Evans |
| 4,502,552 | A | 3/1985 | Martini |
| 4,516,640 | A | 5/1985 | Karlsson |
| 4,516,641 | A | 5/1985 | Burr |
| 4,537,407 | A | 8/1985 | Jansen et al. |
| 4,545,713 | A | 10/1985 | Beni et al. |
| 4,552,233 | A | 11/1985 | Kilma |
| 4,595,065 | A | 6/1986 | Wada et al. |
| 4,600,064 | A | 7/1986 | Scales et al. |
| 4,606,155 | A | 8/1986 | Bukovitz et al. |
| 4,616,454 | A | 10/1986 | Ballachey et al. |
| 4,618,269 | A | 10/1986 | Badrak et al. |
| 4,624,447 | A | 11/1986 | Richmeier |
| 4,626,999 | A | 12/1986 | Bannister |
| 4,627,882 | A | 12/1986 | Soderstrom |
| 4,643,051 | A | 2/1987 | Simons et al. |
| 4,660,444 | A | 4/1987 | Sorensen et al. |
| 4,688,651 | A | 8/1987 | Dysart |
| 4,708,752 | A | 11/1987 | Kar |
| 4,715,180 | A | 12/1987 | Rosman |
| 4,724,930 | A | 2/1988 | VanLierop |
| 4,741,471 | A | 5/1988 | Sullivan |
| 4,753,303 | A | 6/1988 | Burr |
| 4,760,887 | A | 8/1988 | Jansson et al. |
| 4,762,189 | A | 8/1988 | Tatum |
| 4,781,770 | A | 11/1988 | Kar |
| 4,790,390 | A | 12/1988 | Sweeny |
| 4,822,057 | A | 4/1989 | Chia et al. |
| 4,824,123 | A | 4/1989 | Chia et al. |
| 4,844,181 | A | 7/1989 | Bassinger |
| 4,892,992 | A | 1/1990 | Akeel et al. |
| 4,900,187 | A | 2/1990 | Uchida et al. |
| 4,940,099 | A | 7/1990 | Deane et al. |
| 5,005,989 | A | 4/1991 | Karlsson |
| 5,009,519 | A | 4/1991 | Tatum |
| 5,020,777 | A | 6/1991 | Yocum |
| 5,092,635 | A | 3/1992 | DeLange et al. |
| 5,137,097 | A | 8/1992 | Fernandez |
| 5,137,792 | A | 8/1992 | Hodes et al. |
| 5,139,095 | A * | 8/1992 | Lyon et al. ..... 175/68 |
| 5,277,260 | A | 1/1994 | Ranck |
| 5,311,950 | A | 5/1994 | Spektor |
| 5,366,029 | A | 11/1994 | Beck, III |
| 5,390,749 | A | 2/1995 | Lyon |
| 5,396,965 | A | 3/1995 | Hall et al. |
| 5,400,350 | A | 3/1995 | Galvanauskas |
| 5,419,403 | A | 5/1995 | Klemm |
| 5,456,328 | A | 10/1995 | Saxman |
| 5,472,058 | A | 12/1995 | Hooper et al. |
| 5,474,499 | A | 12/1995 | Olson |
| 5,570,750 | A | 11/1996 | Williams |
| 5,586,611 | A | 12/1996 | Dorosz |
| 5,606,753 | A | 3/1997 | Hashimoto |
| 5,662,180 | A | 9/1997 | Coffman et al. |
| 5,725,312 | A | 3/1998 | May |
| 5,730,230 | A | 3/1998 | Sisler |
| 5,735,330 | A | 4/1998 | Buchmann et al. |
| 5,740,703 | A | 4/1998 | Perry |
| 5,791,206 | A | 8/1998 | Daigle et al. |

| | | | | |
|---|---|---|---|---|
| 5,885,160 | A | 3/1999 | Tauvron | |
| 5,944,126 | A | 8/1999 | Brolund | |
| 5,947,215 | A | 9/1999 | Lundell | |
| 5,988,299 | A | 11/1999 | Hansen et al. | |
| 6,002,697 | A | 12/1999 | Govorkov et al. | |
| 6,013,140 | A | 1/2000 | Simoneaux | |
| 6,033,117 | A | 3/2000 | Cariveau et al. | |
| RE36,848 | E * | 9/2000 | Bui et al. | 175/65 |
| 6,123,337 | A | 9/2000 | Fang et al. | |
| 6,173,798 | B1 | 1/2001 | Bryant et al. | |
| 6,176,331 | B1 | 1/2001 | Jin et al. | |
| 6,196,339 | B1 | 3/2001 | Portwood et al. | |
| 6,230,590 | B1 | 5/2001 | Guse | |
| 6,250,407 | B1 | 6/2001 | Karlsson | |
| 6,253,864 | B1 * | 7/2001 | Hall | 175/415 |
| 6,254,275 | B1 | 7/2001 | Slaughter, Jr. et al. | |
| 6,276,453 | B1 | 8/2001 | Bond | |
| 6,298,926 | B1 | 10/2001 | Dalkert et al. | |
| 6,305,483 | B1 | 10/2001 | Portwood | |
| 6,305,515 | B1 | 10/2001 | Heidenreich et al. | |
| 6,315,063 | B1 | 11/2001 | Martini | |
| 6,365,866 | B1 | 4/2002 | Brenner et al. | |
| 6,371,223 | B2 | 4/2002 | Wentworth et al. | |
| 6,374,706 | B1 | 4/2002 | Newman | |
| 6,408,957 | B1 | 6/2002 | Slaughter, Jr. et al. | |
| 6,431,293 | B1 | 8/2002 | Portwood et al. | |
| 6,464,023 | B2 | 10/2002 | Petterson | |
| 6,513,607 | B2 | 2/2003 | Peterson et al. | |
| 6,524,036 | B1 | 2/2003 | Kolker | |
| 6,527,063 | B2 | 3/2003 | Rust et al. | |
| RE38,151 | E | 6/2003 | Penkunas et al. | |
| 6,571,867 | B2 | 6/2003 | Bond | |
| 6,647,035 | B1 | 11/2003 | Freitas et al. | |
| 6,672,410 | B2 | 1/2004 | Smith | |
| 6,675,915 | B2 | 1/2004 | Smith | |
| 6,676,130 | B2 | 1/2004 | Schmitt | |
| 6,679,342 | B2 | 1/2004 | Portwood et al. | |
| 6,695,079 | B2 | 2/2004 | Portwood et al. | |
| 6,761,486 | B2 | 7/2004 | Miyazaki et al. | |
| 6,817,271 | B2 | 11/2004 | Gouws | |
| 6,837,317 | B2 | 1/2005 | Byrd | |
| 6,892,828 | B2 | 5/2005 | Rives | |
| 6,920,375 | B2 | 7/2005 | Enric | |
| 6,986,394 | B2 | 1/2006 | Marsh | |
| 7,000,712 | B2 | 2/2006 | Byrd | |
| 7,059,431 | B2 | 6/2006 | Simon | |
| 7,086,474 | B1 | 8/2006 | Trevithick et al. | |
| 7,117,938 | B2 | 10/2006 | Hamilton et al. | |
| 7,117,961 | B2 | 10/2006 | Yong et al. | |
| 7,188,691 | B2 | 3/2007 | Yong et al. | |
| 7,325,634 | B2 | 2/2008 | Law et al. | |
| 7,347,285 | B2 | 3/2008 | Hamner | |
| 7,347,290 | B2 | 3/2008 | Yu et al. | |
| 7,350,593 | B1 | 4/2008 | Brookover | |
| 7,377,338 | B2 | 5/2008 | Bassinger | |
| 7,391,129 | B2 | 6/2008 | Chiao et al. | |
| 7,392,862 | B2 | 7/2008 | Zahradnik et al. | |
| 7,411,312 | B2 | 8/2008 | Chiao | |
| 7,413,036 | B2 | 8/2008 | Law et al. | |
| 7,428,944 | B2 | 9/2008 | Gerum | |
| 8,011,455 | B2 * | 9/2011 | Lyon et al. | 175/296 |
| 2002/0108788 | A1 | 8/2002 | Peterson et al. | |
| 2003/0056989 | A1 | 3/2003 | Smith | |
| 2003/0121153 | A1 | 7/2003 | Tajima et al. | |
| 2003/0221871 | A1 | 12/2003 | Hamilton et al. | |
| 2004/0003874 | A1 | 1/2004 | Yoshii | |
| 2004/0011567 | A1 | 1/2004 | Singh et al. | |
| 2004/0173379 | A1 | 9/2004 | Leppanen | |
| 2004/0220574 | A1 | 11/2004 | Pelo et al. | |
| 2005/0039953 | A1 | 2/2005 | Crooks | |
| 2005/0045380 | A1 | 3/2005 | Eddison | |
| 2005/0087522 | A1 | 4/2005 | Sun et al. | |
| 2005/0103531 | A1 | 5/2005 | Byrd | |
| 2005/0156057 | A1 | 7/2005 | Hamann et al. | |
| 2006/0027547 | A1 | 2/2006 | Silvestro | |
| 2006/0032673 | A1 | 2/2006 | Yong | |
| 2006/0032674 | A1 | 2/2006 | Chen et al. | |
| 2006/0049157 | A1 | 3/2006 | Lineton et al. | |
| 2007/0045008 | A1 | 3/2007 | Dick | |
| 2007/0102198 | A1 | 5/2007 | Oxford et al. | |
| 2007/0199739 | A1 | 8/2007 | Schwefe et al. | |
| 2007/0246262 | A1 | 10/2007 | Brookover | |
| 2007/0289780 | A1 | 12/2007 | Osborne | |
| 2008/0017465 | A1 | 1/2008 | Pittius et al. | |
| 2008/0041634 | A1 | 2/2008 | Peterson | |
| 2008/0041635 | A1 | 2/2008 | Peterson | |
| 2008/0078584 | A1 | 4/2008 | Lyon | |
| 2008/0149396 | A1 | 6/2008 | Fyfe | |
| 2008/0179103 | A1 | 7/2008 | Langford et al. | |
| 2008/0210469 | A1 | 9/2008 | Volkel et al. | |
| 2009/0062738 | A1 | 3/2009 | Ziegler | |
| 2010/0025046 | A1 | 2/2010 | Francis et al. | |
| 2010/0102513 | A1 | 4/2010 | Peterson | |
| 2010/0200258 | A1 | 8/2010 | Tarnowski et al. | |
| 2010/0230172 | A1 | 9/2010 | Peterson | |
| 2011/0088953 | A1 * | 4/2011 | Rainey et al. | 175/296 |

FOREIGN PATENT DOCUMENTS

| | | |
|---|---|---|
| WO | 02/20934 A1 | 3/2002 |

OTHER PUBLICATIONS

RockSmith DTH Hammer, http;//www.rocksmith.com.au/html/dth_hammer.html, website page.

C.A. Pratt, "Modifications to and Experience With Air-Percussion Drilling", SPE Drilling Engineering, Dec. 1989, pp. 315-320.

Down-the-Hole Hammers: The Range, http://mincon.com/, website page.

DTH Hammers, Hi-Tech Group Pneumatics and Heat Treaters (P) Ltd., hitechpneum@vsnl.net.

International Search Report PCT/US2009/052968 dated Aug. 13, 2010.

* cited by examiner

PERCUSSION ASSISTED ROTARY EARTH BIT AND METHOD OF OPERATING THE SAME

CROSS-REFERENCE TO RELATED APPLICATIONS

This application claims priority to U.S. Provisional Application No. 61/086,740, filed on Aug. 6, 2008 by the same inventors, the contents of which are incorporated by reference as though fully set forth herein.

BACKGROUND OF THE INVENTION

1. Field of the Invention

This invention relates to earth bits for drilling.

2. Description of the Related Art

An earth bit is commonly used for boring through a formation to form a borehole. Such boreholes may be formed for many different reasons, such as drilling for oil, minerals and geothermal steam. There are several different types of earth bits that are used forming a borehole. One type is a tri-cone rotary earth bit and, in a typical setup, it includes three earth bit cutting cones rotatably mounted to separate lugs. The lugs are joined together through welding to form a bit body. The earth bit cutting cones rotate in response to contacting the formation as the earth bit body is rotated in the borehole. Several examples of rotary earth bits are disclosed in U.S. Pat. Nos. 3,550,972, 3,847,235, 4,136,748, 4,427,307, 4,688,651, 4,741,471 and 6,513,607.

Some attempts have been made to form boreholes at a faster rate, as discussed in more detail in U.S. Pat. Nos. 3,250,337, 3,307,641, 3,807,512, 4,502,552, 5,730,230, 6,371,223 and 6,986,394, as well as in U.S. Patent Application No. 20050045380. Some of these references disclose using a percussion hammer to apply an overstrike force to the earth bit. However, it is desirable to increase the boring rate when using the percussion hammer, and to reduce the amount of damage to the earth bit in response to the overstrike force.

BRIEF SUMMARY OF THE INVENTION

The present invention is directed to a percussion assisted rotary earth bit, and method of operating the same. The novel features of the invention are set forth with particularity in the appended claims. The invention will be best understood from the following description when read in conjunction with the accompanying drawings.

These and other features, aspects, and advantages of the present invention will become better understood with reference to the following drawings and description.

BRIEF DESCRIPTION OF THE DRAWINGS

FIGS. 5*a* and 5*b* are side views of the rotary drilling system of FIGS. 2*a* and 2*b* with the rotary earth bit in retracted and extended positions, respectively.

DETAILED DESCRIPTION OF THE INVENTION

Figure 1:
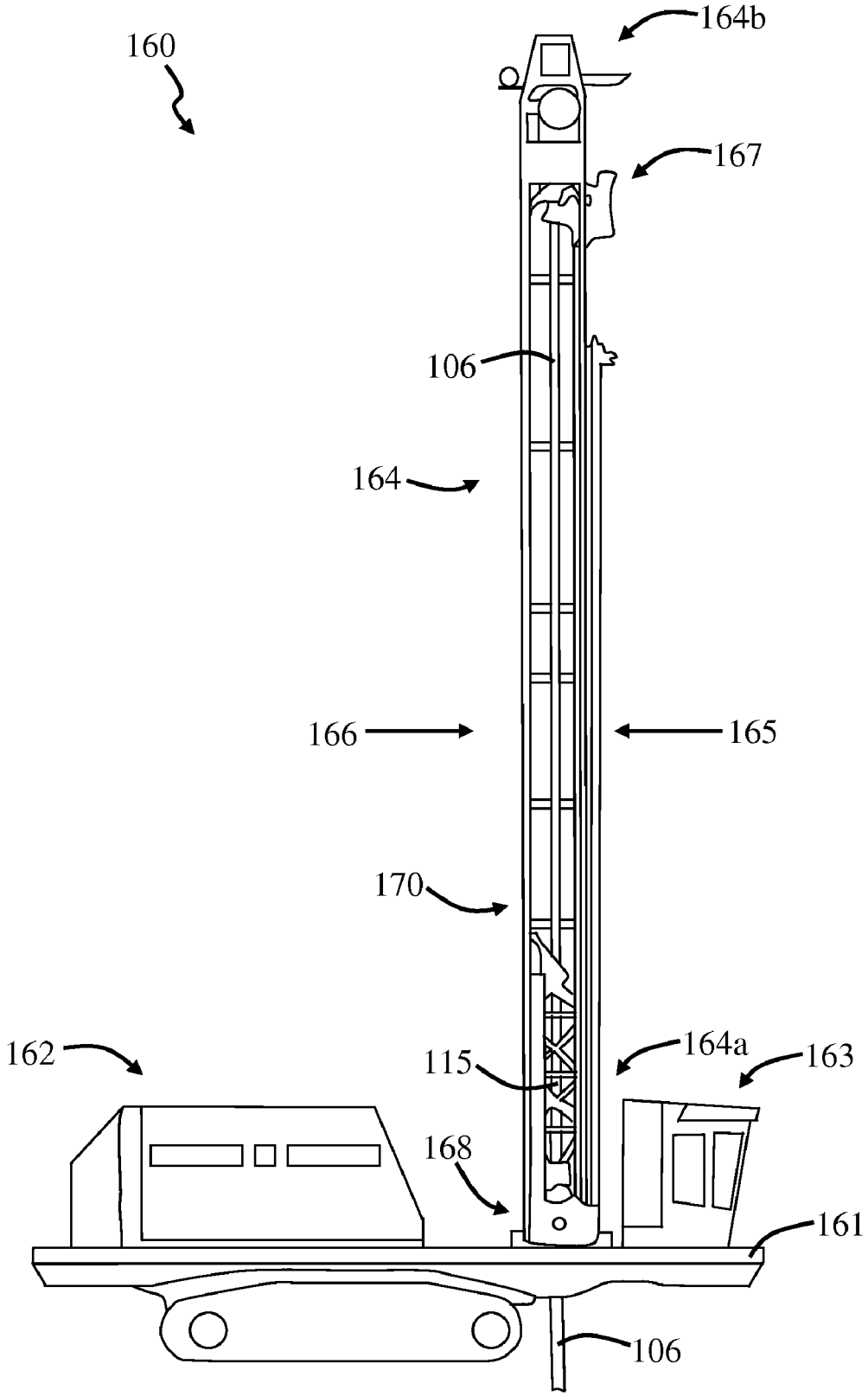
FIG. 1 is a side view of a drilling rig coupled with a drill string.

FIG. 1 is a side view of a drilling machine 160 coupled with a drill string 106. In this embodiment, drilling machine 160 includes a platform 161 which carries a prime mover 162 and cab 163. A tower base 164*a* of a tower 164 is coupled to platform 161 by a tower coupler 168, and tower coupler 168 allows tower 164 to repeatably move between raised and lowered positions. In the raised position, which is shown in FIG. 1, a tower crown 164*b* of tower 164 is away from platform 161. In the raised position, a front 165 of tower 164 faces cab 163 and a back 166 of tower 164 faces prime mover 162. In the lowered position, back 166 of tower 164 is moved towards platform 161 and prime mover 162.

Tower 164 generally carries a feed cable system (not shown) attached to a rotary head 167, wherein the feed cable system allows rotary head 167 to move between raised and lowered positions along tower 164. The feed cable system moves rotary head 167 to the raised and lowered positions by moving it towards tower crown 164*b* and tower base 164*a*, respectively.

Rotary head 167 is moved between the raise and lowered positions to raise and lower, respectively, drill string 106 through a borehole. Further, rotary head 167 is used to rotate drill string 106, wherein drill string 106 extends through tower 164. Drill string 106 generally includes one or more drill pipes connected together in a well-known manner. The drill pipes of drill string 106 are capable of being attached to an earth bit, such as a tri-cone rotary earth bit.

Figure 2A:
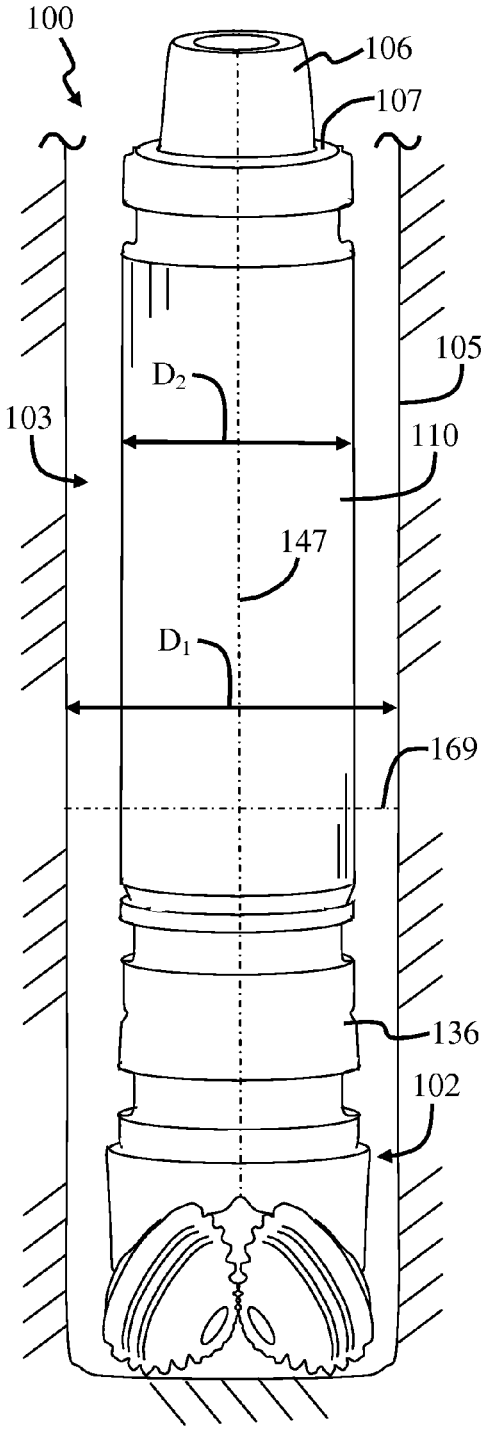
FIG. 2*a* is a perspective view of a rotary drill system coupled to the drill string of FIG. 1, wherein the rotary drill system includes a rotary earth bit coupled to a hammer assembly.
Figure 2B:
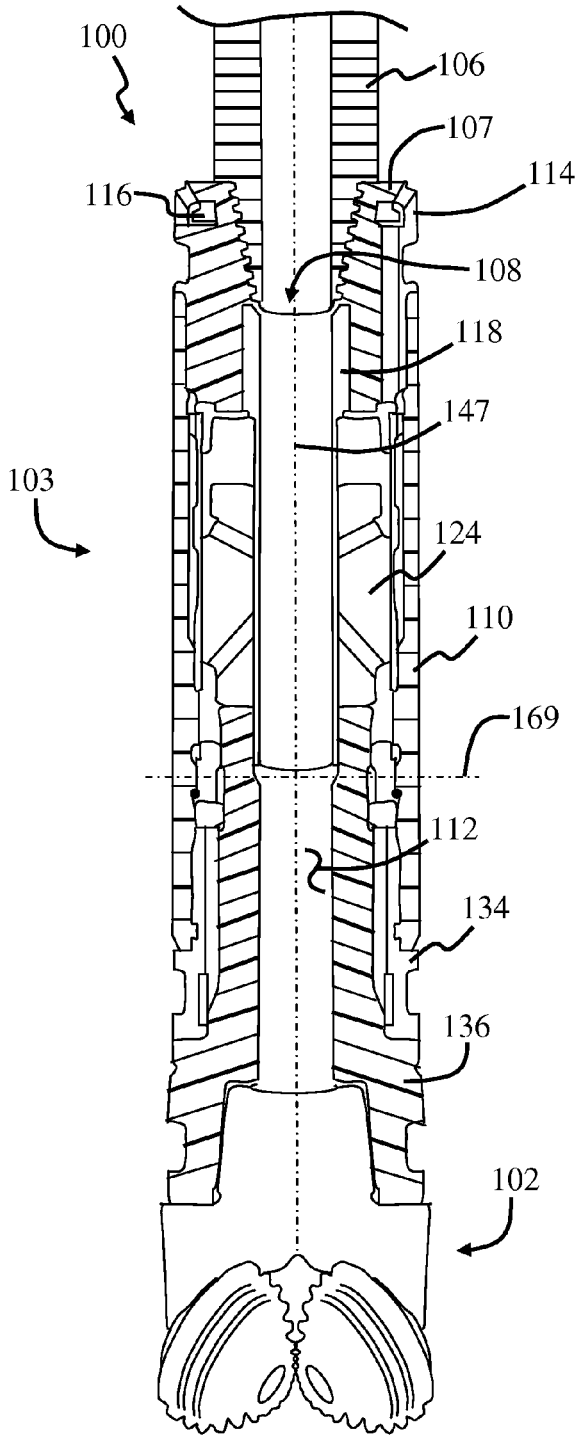
FIG. 2*b* is a cut-away side view of the rotary drill system of FIG. 2*a* coupled to the drill string.

FIG. 2*a* is a perspective view of a rotary drill system 100 coupled to drill string 106, and FIG. 2*b* is a cut-away side view of rotary drill system 100 coupled to drill string 106. In FIG. 2*a*, rotary drill system 100 extends longitudinally through a borehole 105. A centerline 147 extends longitudinally along a center of rotary drill system 100, and a radial line 169 extends radially and perpendicular to centerline 147.

Borehole 105 has a circular cross-sectional shape in response to rotary drill system 100 having a circular cross-sectional shape. Borehole 105 has a cross-sectional dimension $D_1$, which corresponds to a diameter when borehole 105 has a circular cross-sectional shape. Further, rotary drill system 100 has a cross-sectional dimension $D_2$, which corresponds to a diameter when rotary drill system 100 has a circular cross-sectional shape.

The value of dimension $D_1$ corresponds to the value of dimension $D_2$. For example, dimension $D_1$ increases and decreases in response to increasing and decreasing dimension $D_2$, respectively. It should be noted that the cross-sectional shapes of borehole 105 and rotary drill system 100 are determined by forming a cut-line through borehole 105 and rotary drill system 100, respectively, in a direction along radial line 169.

In this embodiment, rotary drill system 100 includes a rotary earth bit 102 coupled to a hammer assembly 103. Rotary earth bit 102 is repeatably moveable between coupled and decoupled conditions with hammer assembly 103, as will be discussed in more detail below with FIG. 7*a*. Rotary earth bit 102 can be of many different types. In this embodiment, rotary earth bit 102 is embodied as a tri-cone rotary earth bit. A tri-cone rotary earth bit includes three lugs coupled together to form an earth bit body, wherein each lug carries a cutting cone rotatably mounted thereto. In general, rotary earth bit 102 includes one or more lugs, and a corresponding cutting cone rotatably mounted to each lug. It should be noted that two cutting cones are shown in FIGS. 2*a* and 2*b* for illustrative purposes.

In this embodiment, hammer assembly 103 includes a rotary tool joint 107 with a central opening 104 (FIG. 3*a*) extending therethrough. One end of drill string 106 is coupled to drilling machine 160 (FIG. 1) and the other end of drill string 106 is coupled to rotary drill system 100 through tool joint 107. In particular, one end of drill string 106 is coupled to rotary head 167 and the other end of drill string 106 is coupled to rotary drill system 100 through tool joint 107. More information regarding drilling machines is provided in U.S. Pat. Nos. 4,320,808, 6,276,453, 6,315,063 and 6,571,867, the contents of all of which are incorporated herein by reference.

The connection between drill string 106 and rotary tool joint 107 is often referred to as a threaded box connection. Drill string 106 is coupled to rotary drill system 100 so that drill string 106 is in fluid communication with rotary earth bit 102 through hammer assembly 103. Drill string 106 provides fluid to hammer assembly 103 through a drill string opening 108 and central opening 104 of tool joint 107. Drilling machine 160 flows the fluid to earth bit 102 and hammer assembly 103 through rotary head 167 and drill string 106. Rotary earth bit 102 outputs some of the fluid so that cuttings are lifted upwardly through borehole 105. Drilling machine 160 provides the fluid with a desired pressure to clean rotary earth bit 102, as well as to evacuate cuttings from borehole 105. As will be discussed in more detail below, drilling machine 160 provides the fluid with the desired pressure to actuate hammer assembly 103.

The fluid can be of many different types, such as a liquid and/or gas. The liquid can be of many different types, such as oil, water, drilling mud, and combinations thereof. The gas can be of many different types, such as air and other gases. In some situations, the fluid includes a liquid and gas, such as air and water. It should be noted that drilling machine 160 (FIG. 1) typically includes a compressor (not shown) which provides a gas, such as air, to the fluid. The fluid is used to operate rotary earth bit 102, and to actuate hammer assembly 103. For example, the fluid is used to lubricate and cool rotary earth bit 102 and, as discussed in more detail below, to actuate hammer assembly 103.

It should also be noted that drill string 106 is typically rotated by rotary head 167, and rotary drill system 100 rotates in response to the rotation of drill string 106. Drill string 106 can be rotated at many different rates. For example, in one situation, rotary head 167 rotates drill string 106 at a rate less than about one-hundred and fifty revolutions per minute (150 RPM). In one particular situation, rotary head 167 rotates drill string 106 at a rate between about fifty revolutions per minute (50 RPM) to about one-hundred and fifty revolutions per minute (150 RPM). In some situations, rotary head 167 rotates drill string 106 at a rate between about forty revolutions per minute (40 RPM) to about one-hundred revolutions per minute (100 RPM). In another situation, rotary head 167 rotates drill string 106 at a rate between about one-hundred revolutions per minute (100 RPM) to about one-hundred and fifty revolutions per minute (150 RPM). In general, the penetration rate of rotary drill system 100 increases and decreases as the rotation rate of drill string 106 increases and decreases, respectively. Hence, the penetration rate of rotary drill system 100 is adjustable in response to adjusting the rotation rate of drill string 106.

In most embodiments, earth bit 102 operates with a weight-on-bit applied thereto. In general, the penetration rate of rotary drill system 100 increases and decreases as the weight-on-bit increases and decreases, respectively. Hence, the penetration rate of rotary drill system 100 is adjustable in response to adjusting the weight-on-bit.

The weight-on-bit is generally applied to earth bit 102 through drill string 106 and hammer assembly 103. The weight-on-bit can be applied to earth bit 102 through drill string 106 and hammer assembly 103 in many different ways. For example, drilling machine 160 can apply the weight-on-bit to earth bit 102 through drill string 106 and hammer assembly 103. In particular, rotary head 167 can apply the weight-on-bit to earth bit 102 through drill string 106 and hammer assembly 103. The value of the weight-on-bit depends on many different factors, such as the ability of earth bit 102 to withstand the weight-on-bit without failing. Earth bit 102 is more likely to fail if the applied weight-on-bit is too large.

The weight-on-bit can have weight values in many different ranges. For example, in one situation, the weight-on-bit is less than ten-thousand pounds per square inch (10,000 psi) of borehole diameter. In one particular situation, the weight-on-bit is in a range of about one-thousand pounds per square inch (1,000 psi) of borehole diameter to about ten-thousand pounds per square inch (10,000 psi) of borehole diameter. In one situation, the weight-on-bit is in a range of about two-thousand pounds per square inch (2,000 psi) of borehole diameter to about eight-thousand pounds per square inch (8,000 psi) of borehole diameter. In another situation, the weight-on-bit is in a range of about four-thousand pounds per square inch (4,000 psi) of borehole diameter to about six-thousand pounds per square inch (6,000 psi) of borehole diameter. It should be noted that the borehole diameter of the weight-on-bit corresponds to dimension $D_1$ of borehole 105, which corresponds to dimension $D_2$ of rotary drill system 100, as discussed in more detail above.

The weight-on-bit can also be determined using units other than the number of pounds per square inch of borehole diameter. For example, in some situations, the weight-on-bit is less than about one-hundred and thirty thousand pounds (130,000 lbs). In one particular situation, the weight-on-bit is in a range of about thirty-thousand pounds (30,000 lbs) to about one-hundred and thirty thousand pounds (130,000 lbs). In one situation, the weight-on-bit is in a range of about ten-thousand pounds (10,000 lbs) to about sixty-thousand pounds (60,000 lbs). In another situation, the weight-on-bit is in a range of about sixty-thousand pounds (60,000 lbs) to about one-hundred and twenty thousand pounds (120,000 lbs). In one situation, the weight-on-bit is in a range of about ten-thousand pounds (10,000 lbs) to about forty-thousand pounds (40,000 lbs). In another situation, the weight-on-bit is in a range of about eighty-thousand pounds (80,000 lbs) to about one-hundred and ten thousand pounds (110,000 lbs).

During operation, hammer assembly 103 applies an overstrike force to rotary earth bit 102. It should be noted, however, that the overstrike force can be applied to rotary earth bit 102 in many other ways. For example, in one embodiment, the overstrike force is applied to earth bit 102 by a spring actuated mechanical tool. In another embodiment, the overstrike force is applied to earth bit 102 by a spring actuated mechanical tool instead of an air operated hammer. In some embodiments, the overstrike force is applied to earth bit 102 by an electromechanical powered tool. some embodiments, the overstrike force is applied to earth bit 102 by an electromechanical powered tool instead of an air operated hammer.

In the embodiment of FIGS. 2*a* and 2*b*, hammer assembly 103 applies the overstrike force to rotary earth bit 102 in response to being actuated. As mentioned above, hammer assembly 103 is actuated in response to a flow of the fluid therethrough, wherein the fluid is provided by drilling machine 160 through drill string 106. Drilling machine 160 provides the fluid with a controlled and adjustable pressure. As discussed in more detail below, the fluid pressure is provided so that hammer assembly 103 is actuated with a desired frequency and amplitude. In this way, hammer assembly 103 provides a desired overstrike force to rotary earth bit 102.

In operation, hammer assembly 103 is actuated as the cutting cone(s) of rotary earth bit 102 make contact with a formation. Hammer assembly 103 applies the overstrike force to rotary earth bit 102 and, in response, rotary earth bit 102 advances into the formation as the cutting cone(s) fracture it. The rate at which the formation is fractured is influenced by the magnitude and frequency of the force provided by hammer assembly 103 in response to being actuated. In this way, hammer assembly 103 drives rotary earth bit 102 into the formation, and borehole 105 is formed. It should be noted that the magnitude of the overstrike force typically corresponds with the absolute value of the amplitude of the overstrike force.

Figure 3A:
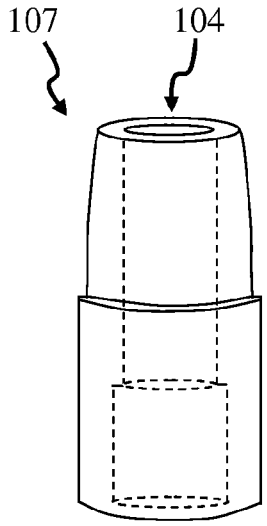
FIG. 3*a* is a perspective view of a rotary tool joint included with the hammer assembly of FIGS. 2*a* and 2*b*.

As mentioned above, hammer assembly 103 includes rotary tool joint 107 with central opening 104 extending therethrough, wherein rotary tool joint 107 is shown in a perspective view in FIG. 3*a*. Central opening 104 allows fluid to flow through rotary tool joint 107. Drill string 106 is coupled to hammer assembly 103 through rotary tool joint 107. In this way, drill string 106 is coupled to rotary drill system 100.

Figure 3B:
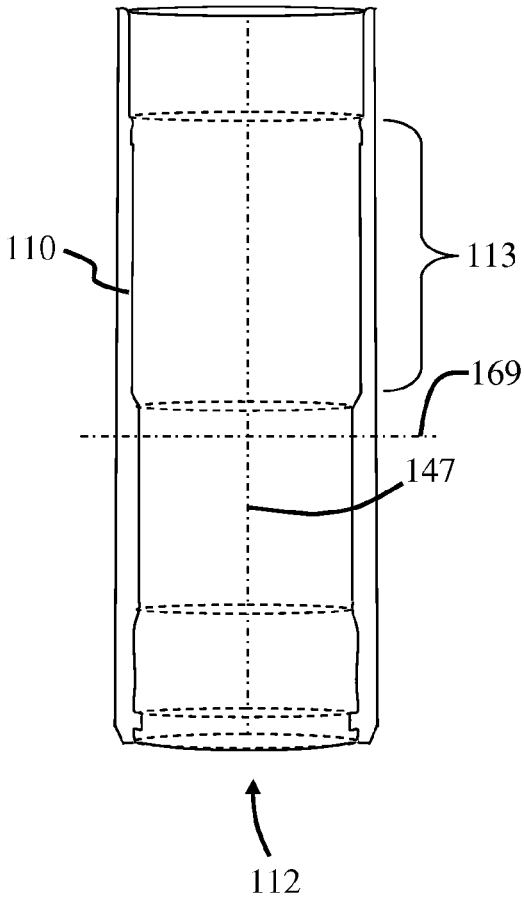
FIG. 3*b* is a perspective view of a hammer casing included with the hammer assembly of FIGS. 2*a* and 2*b*.

In this embodiment, hammer assembly 103 includes a hammer casing body 110, which is shown in a perspective view in FIG. 3*b*. Here, hammer casing body 110 is cylindrical in shape with a circular cross-sectional shape. Hammer casing body 110 has opposed openings, and a central channel 112 which extends between the opposed openings. Hammer casing body 110 defines a piston cylinder 113 (FIG. 3*b*) which is a portion of central channel 112. It should be noted that rotary tool joint 107 is coupled to hammer casing body 110 so that central channel 112 is in fluid communication with central opening 104. Further, drill string 106 is in fluid communication with earth bit 102 and hammer assembly 103 through central channel 112.

Rotary tool joint 107 can be coupled to hammer casing body 110 in many different ways. In this embodiment, rotary tool joint 107 is coupled to hammer casing body 110 with a backhead 114 (FIG. 2*b*). Backhead 114 is threadingly engaged with hammer casing body 110 and has a central opening sized and shaped to receive rotary tool joint 107. A throttle plate 116 is positioned between backhead 114 and rotary tool joint 107. Throttle plate 116, along with a check valve 115 (FIG. 6) restrict the backflow of cuttings and debris into hammer assembly 103. Throttle plate 116 and check valve 115 also restrict the airflow through hammer assembly 103, as will be discussed in more detail below. Throttle plate 116 and check valve 115 are positioned towards the rearward end of hammer assembly 103 to allow them to be adjusted without having to remove rotary drill system 100 from borehole 105. This allows the in-field adjustment of the exhaust pressure in hammer assembly 103 to adjust its power output.

Figure 3C:
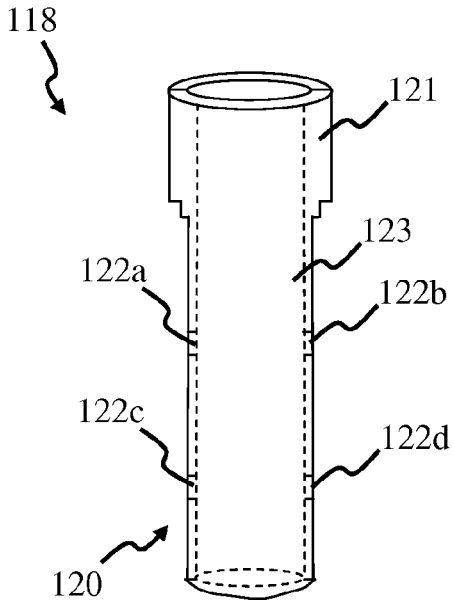
FIG. 3*c* is a perspective view of a flow control tube included with the hammer assembly of FIGS. 2*a* and 2*b*.

In this embodiment, hammer assembly 103 includes a flow control tube 118, which is shown in a perspective view in FIG. 3*c*. In this embodiment, flow control tube 118 extends through central opening 104 of rotary tool joint 107, as well as through central channel 112. Control tube 118 includes a flow control tube body 120 with head and sleeve portions 121 and 123. Sleeve portion 123 extends through central channel 112 away from drill string 106. Control tube 118 includes opposed drive guide ports 122*a* and 122*b* and opposed return guide ports 122*c* and 122*d*, which extend through sleeve portion 123.

Figure 3D:
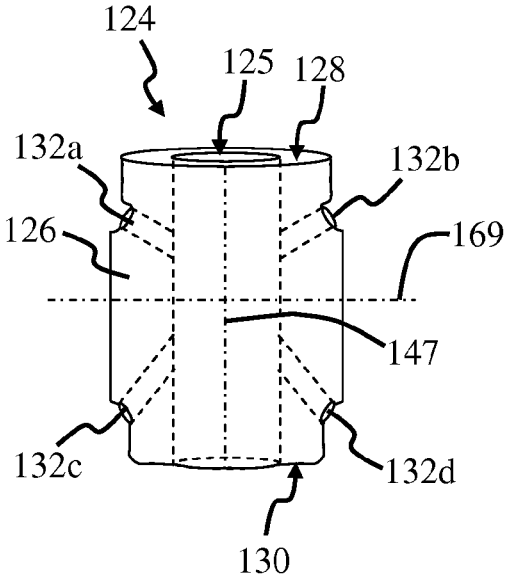
FIG. 3*d* is a perspective view of a piston included with the hammer assembly of FIGS. 2*a* and 2*b*.

In this embodiment, hammer assembly 103 includes a piston 124, which is shown in a perspective view in FIG. 3*d*. In this embodiment, piston 124 is positioned within piston cylinder 113 of hammer casing body 110. Piston 124 includes a piston body 126 with a central opening 125 through which sleeve portion 123 extends. Central opening 125 extends between a drive surface 128 and return surface 130 of piston body 126. Drive surface 128 faces towards rotary tool joint 107 and return surface 130 faces away from rotary tool joint 107. Piston body 126 is positioned within cylinder 113 so that cylinder 113 has a return chamber 140 adjacent to return surface 130 and a drive chamber 141 adjacent to drive surface 128, as will be discussed in more detail with FIGS. 4*a* and 4*b*.

In this embodiment, piston body 126 includes opposed drive piston ports 132*a* and 132*b* and opposed return piston ports 132*c* and 132*d*. Drive piston ports 132*a* and 132*b* and return piston ports 132*c* and 132*d* extend between central opening 125 and the outer periphery of piston body 126. Drive piston ports 132*a* and 132*b* and return piston ports 132*c* and 132*d* can extend through piston body 126 in many different ways. In this embodiment, drive piston ports 132*a* and 132*b* are angled towards drive surface 128. Drive piston ports 132*a* and 132*b* are angled towards drive surface 128 so that drive piston ports 132*a* and 132*b* are not parallel to radial line 169. Drive piston ports 132*a* and 132*b* are angled towards drive surface 128 so that drive piston ports 132*a* and 132*b* are not parallel to centerline 147. Further, return piston ports 132*c* and 132*d* are angled towards return surface 130. Return piston ports 132*c* and 132*d* are angled towards drive surface 130 so that return piston ports 132*c* and 132*d* are not parallel to radial line 169. Return piston ports 132*c* and 132*d* are angled towards drive surface 130 so that return piston ports 132*c* and 132*d* are not parallel to centerline 147.

As will be discussed in more detail below, piston body 126 is repeatably moveable, along sleeve portion 123, between a first position wherein drive piston ports 132*a* and 132*b* are in fluid communication with central channel 112 through drive guide ports 122*a* and 122*b*, respectively, and a second position wherein return piston ports 132*c* and 132*d* are in fluid communication with central channel 112 through return guide ports 122*c* and 122*d*, respectively. It should be noted that, in the first position, return piston ports 132*c* and 132*d* are not in fluid communication with central channel 112 through return guide ports 122*c* and 122*d*. Further, in the second position, drive piston ports 132*a* and 132*b* are not in fluid communication with central channel 112 through drive guide ports 122*a* and 122*b*. Hence, in the first position, material from central channel 112 is restricted from flowing through return piston ports 132*c* and 132*d* by piston body 126. Further, in the second position, material from central channel 112 is restricted from flowing through drive piston ports 132*a* and 132*b* by piston body 126. The flow of material through the ports of hammer assembly 103 is discussed in more detail with FIGS. 4*a* and 4*b*, wherein the first and second positions of piston 124 correspond to disengaged and engaged positions, respectively.

Figure 3E:
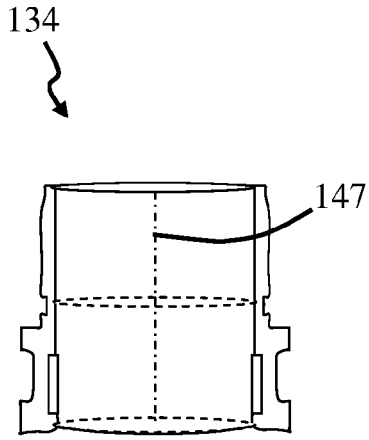
FIG. 3*e* is a perspective view of a drive chuck included with the hammer assembly of FIGS. 2*a* and 2*b*.

In this embodiment, hammer assembly 103 includes a drive chuck 134, which is shown in a perspective view in FIG. 3*e*. Drive chuck 134 is coupled to hammer casing body 110. Drive chuck 134 can be coupled to hammer casing body 110 in many different ways. In this embodiment, drive chuck 134 is coupled to hammer casing body 110 by threadingly engaging them together.

Figure 3F:
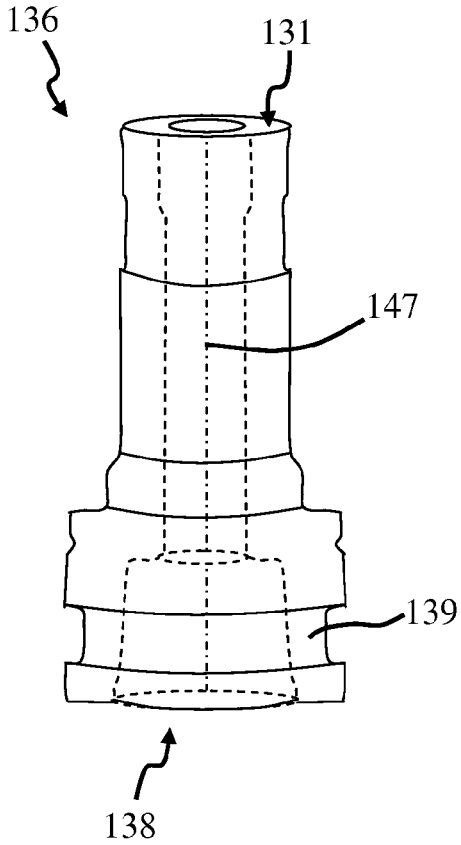
FIG. 3*f* is a perspective view of an adapter sub included with the hammer assembly of FIGS. 2*a* and 2*b*.

In this embodiment, hammer assembly 103 includes an adapter sub 136, which is shown in a perspective view in FIG. 3*f*. Adapter sub 136 is coupled to hammer casing body 110, which can be done in many different ways. In this embodiment, adapter sub 136 is slidingly coupled to drive chuck 134, which, as mentioned above, is coupled to hammer casing body 110. In this way, adapter sub 136 can slide relative to drive chuck 134. Adapter sub 136 includes a rotary earth bit opening 138 and a tool joint 139 at one end. At an opposed end, adapter sub 136 includes an impact surface 131 which faces return surface 130. It should be noted that drive surface 128 faces away from impact surface 131.

As mentioned above, rotary drill system 100 includes rotary earth bit 102 coupled to hammer assembly 103. Rotary earth bit 102 can be coupled to hammer assembly 103 in many different ways. In this embodiment, rotary earth bit 102 is coupled to hammer assembly 103 by coupling it to adapter sub 136. In this embodiment, rotary earth bit 102 is coupled to adapter sub 136 by extending it through rotary earth bit opening 138 and coupling it to tool joint 139. Rotary earth bit 102 is repeatably moveable between coupled and decoupled conditions with adapter sub 136, as will be discussed in more detail with FIG. 7*a*.

It should be noted that rotary earth bit 102 can slide relative to drive chuck 134 because it is coupled to adapter sub 136, which is slidingly coupled to drive chuck 134. Hence, rotary earth bit 102 slides relative to drive chuck 134 in response to adapter sub 136 sliding relative to drive chuck 134. In this way, adapter sub 136 and rotary earth bit 102 can slide relative to drive chuck 134 and hammer casing body 110.

Figure 4A:
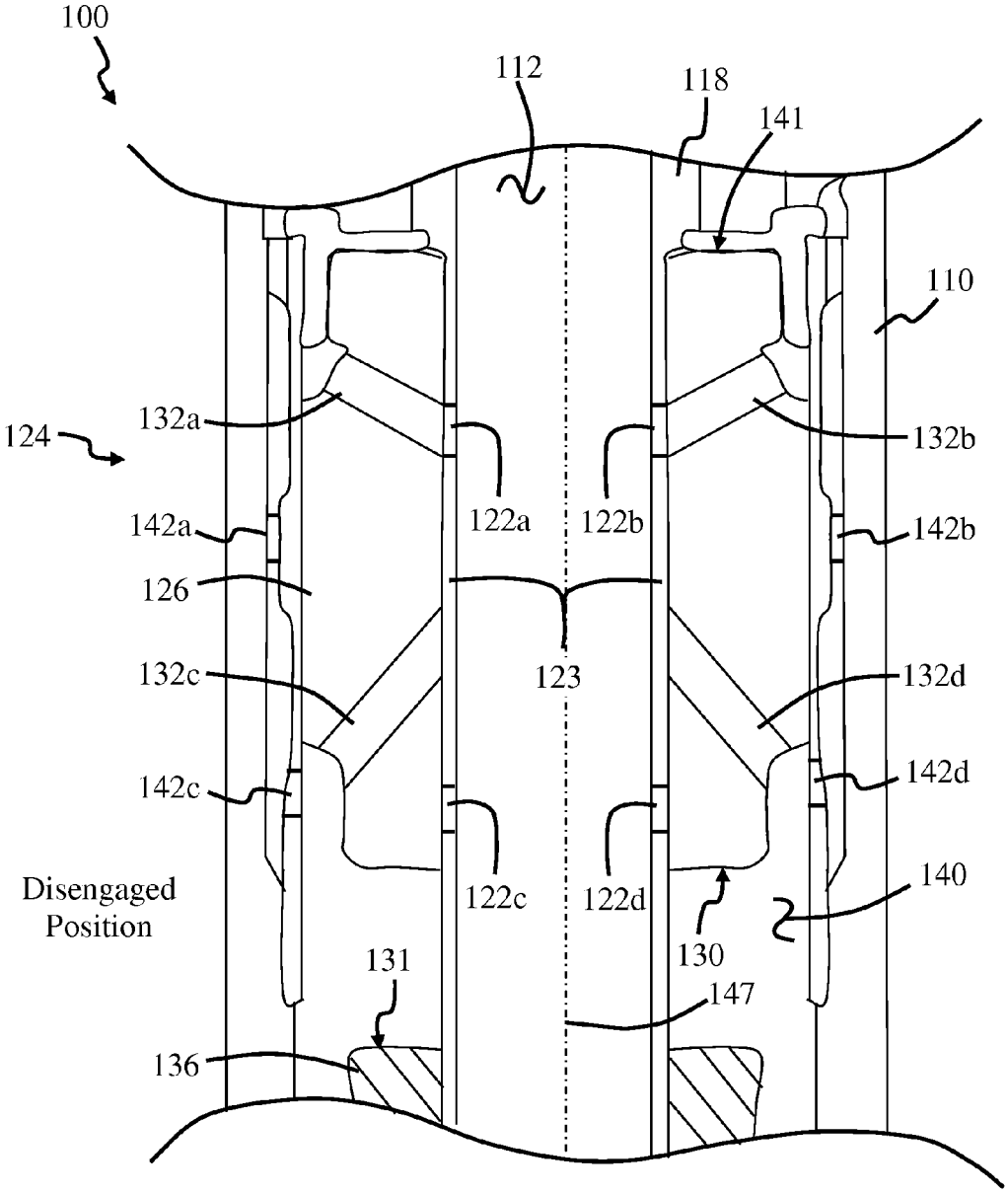
FIGS. 4*a* and 4*b* are close-up side views of the hammer assembly of FIGS. 2*a* and 2*b* showing the piston in the first and second positions, respectively.
Figure 4B:
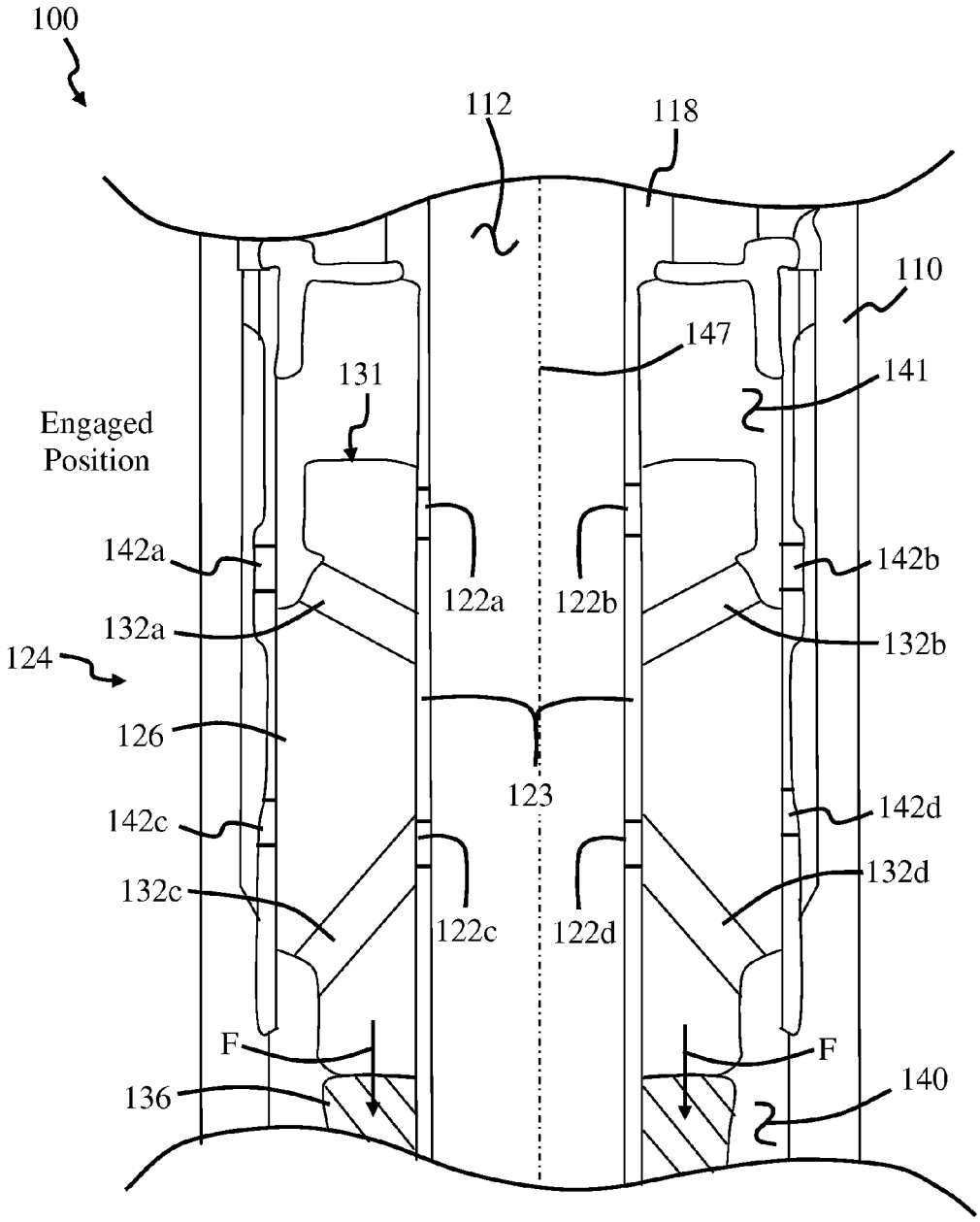

As will be discussed in more detail with FIGS. 4*a* and 4*b*, adapter sub 136 slides in response to the movement of piston 124, which applies an overstrike force F to it (FIG. 4*b*). As will be discussed in more detail with FIGS. 5*a* and 5*b*, rotary earth bit 102 moves between extended and retracted positions in response to the sliding of adapter sub 136. In this way, rotary earth bit 102 moves between extended and retracted positions in response to the movement of piston 124 between the first and second positions.

Figure 5A:
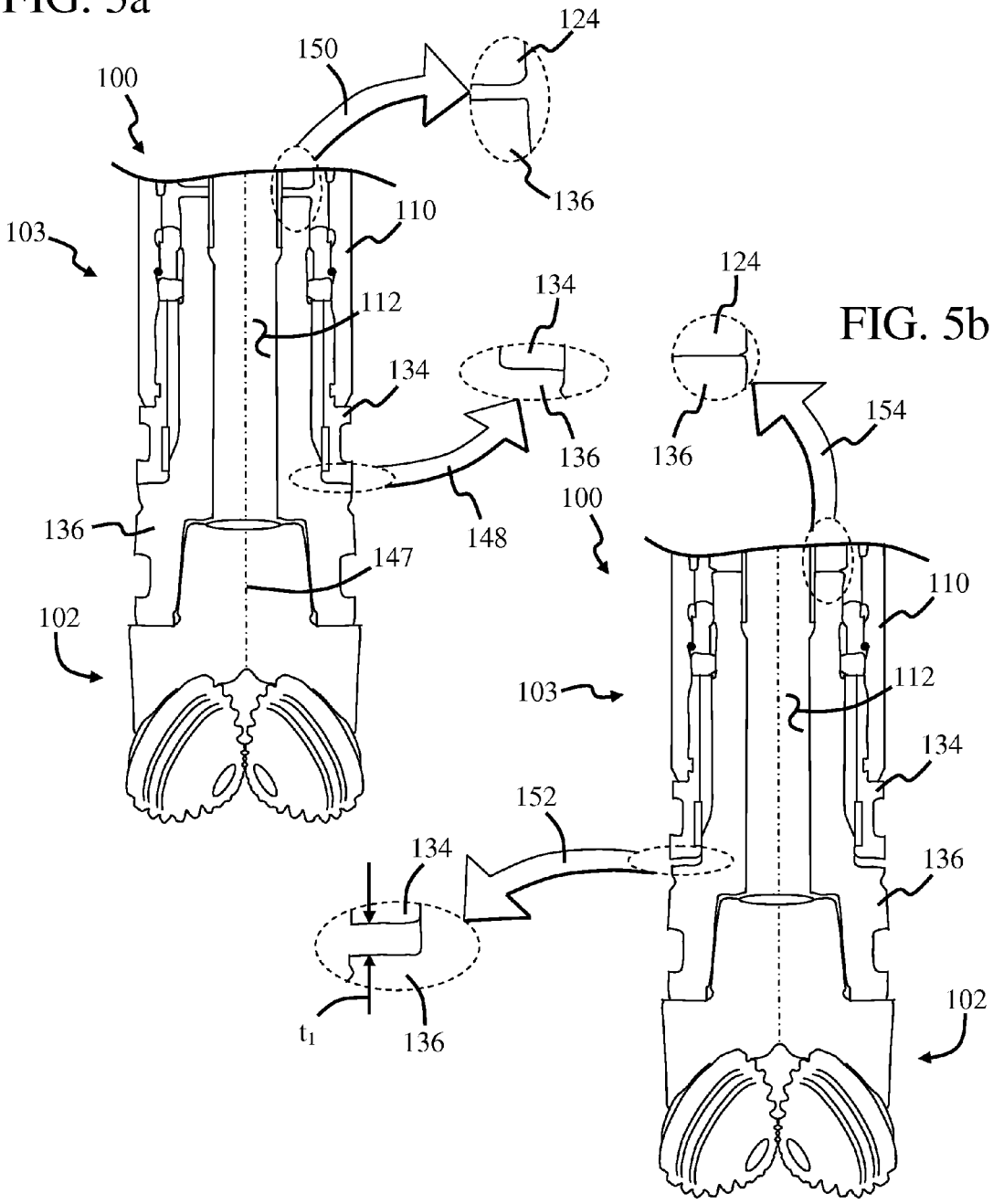
Figure 6:
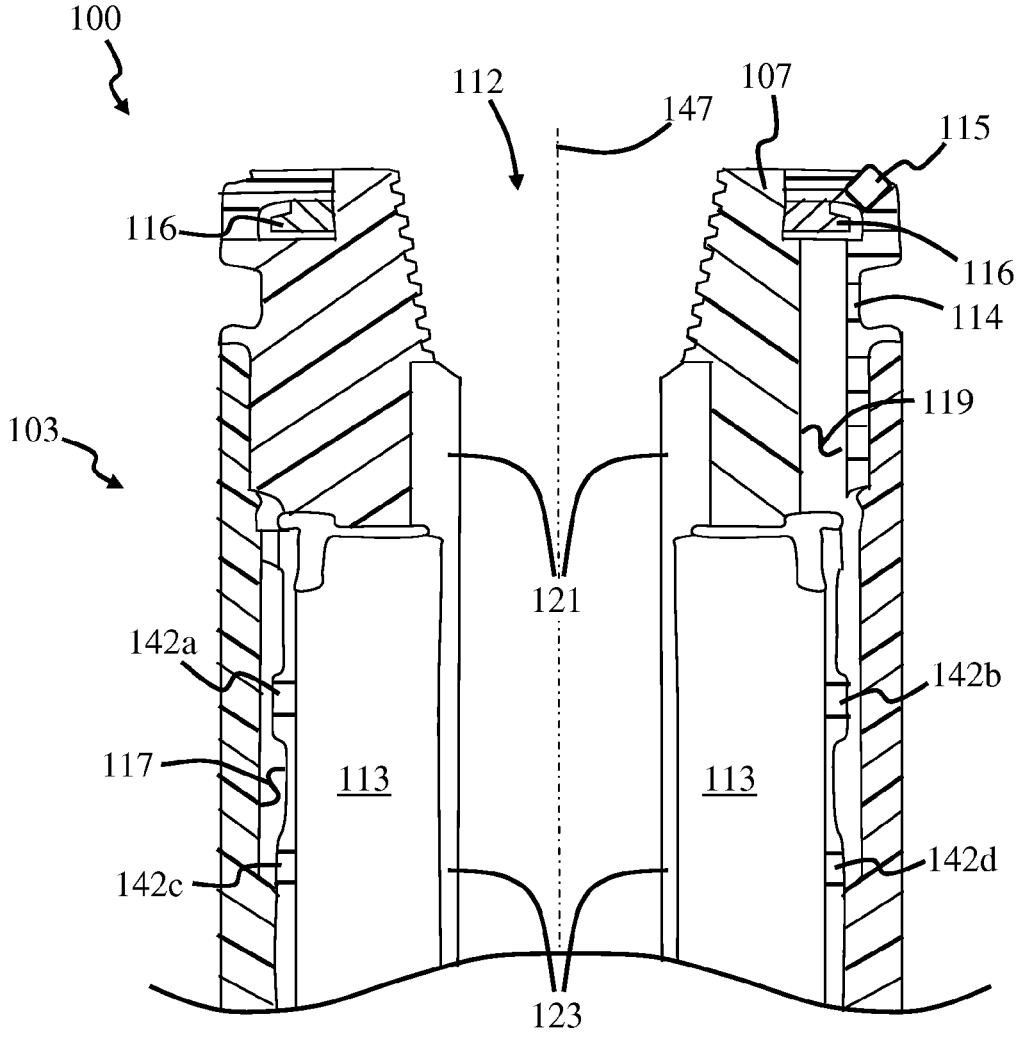
FIG. 6 is a side view of a backhead of the hammer assembly of FIGS. 2*a* and 2*b*.

FIGS. 4*a* and 4*b* are close-up side views of hammer assembly 103 showing piston 124 in the first and second positions, respectively. Further, FIGS. 5*a* and 5*b* are side views of drilling system 100 with rotary earth bit 102 in retracted and extended positions, respectively. FIG. 6 is a side view of a backhead of hammer assembly 103 showing how the fluids are exhausted by rotary drill system 100.

In this embodiment, hammer assembly 103 includes drive exhaust ports 142*a* and 142*b* in fluid communication with drive chamber 141. Further, hammer assembly 103 includes return exhaust ports 142*c* and 142*d* in fluid communication with return chamber 140. Drive exhaust ports 142*a* and 142*b* allow material to flow from drive chamber 141 to a region external to hammer assembly 103. Further, return exhaust ports 142*c* and 142*d* allow material to flow from return chamber 140 to a region external to hammer assembly 103. The flow of material from return chamber 140 and drive chamber 141 will be discussed in more detail with FIG. 6.

In this embodiment, piston 124 is repeatably moveable between the first and second positions. In the first position, piston 124 is disengaged from adapter sub 136 and, in the second position, piston 124 is engaged with adapter sub 136. In the disengaged position, piston body 126 is positioned so that drive piston ports 132*a* and 132*b* are in fluid communication with central channel 112 through drive guide ports 122*a* and 122*b*, respectively. In the disengaged position, piston body 126 is positioned so that return piston ports 132*c* and 132*d* are not in fluid communication with central channel 112 through return guide ports 122*c* and 122*d*. In the disengaged position, piston body 126 restricts the flow of material through return guide ports 122*c* and 122*d*. Further, in the disengaged position, piston body 126 is positioned so that return chamber 140 is in fluid communication with return exhaust ports 142*c* and 142*d* and drive chamber 141 is not in fluid communication with drive exhaust ports 142*a* and 142*b*.

In the engaged position, piston body 126 is positioned so that drive piston ports 132*a* and 132*b* are not in fluid communication with central channel 112 through drive guide ports 122*a* and 122*b*. In the engaged position, piston body 126 is positioned so that return piston ports 132*c* and 132*d* are in fluid communication with central channel 112 through return guide ports 122*c* and 122*d*, respectively. In the engaged position, piston body 126 restricts the flow of material through drive guide ports 122*a* and 122*b*. Further, in the engaged position, piston body 126 is positioned so that return chamber 140 is not in fluid communication with return exhaust ports 142*c* and 142*d* and drive chamber 141 is in fluid communication with drive exhaust ports 142*a* and 142*b*.

In one situation, piston 124 is in the disengaged position, as shown in FIG. 4*a*, so that return chamber 140 is in fluid communication with return exhaust ports 142*c* and 142*d*. In this way, the fluid in return chamber 140 is capable of flowing from return chamber 140 to the region external to hammer assembly 103. Further, drive chamber 141 is in fluid communication with central channel 112 through drive piston ports 132*a* and 132*b* through drive guide ports 122*a* and 122*b*, respectively. In this way, the fluid flowing through central channel 112 that is provided through drill string opening 108 is capable of flowing into drive chamber 141. As the fluid flows into drive chamber 141, its pressure increases, which applies an overstrike force to drive surface 128 of piston body 126 and moves piston body 126 along sleeve portion 123 away from head portion 121.

Piston body 126 moves, in response to overstrike force F applied to drive surface 128, towards adapter sub 136, wherein return surface 130 engages impact surface 131. Adapter sub 136 slides relative to drive chuck 134 in response to return surface 130 engaging impact surface 131. As mentioned above, rotary earth bit 102 is coupled to adapter sub 136. Hence, rotary earth bit 102 also slides in response to return surface 130 engaging impact surface 131, wherein rotary earth bit slides so it is moved from a retracted position (FIG. 5*a*) to an extended position (FIG. 5*b*).

In the retracted position, adapter sub 136 is engaged with drive chuck 134, as indicated by an indication arrow 148 in FIG. 5*a*. Further, piston 124 is disengaged from impact surface 131 of adapter sub 136, as indicated by an indication arrow 150 in FIG. 5*a*. In the extended position, adapter sub 136 is disengaged from drive chuck 134 by a distance $t_1$, as indicated by an indication arrow 152 in FIG. 5*b*. Further, piston 124 is engaged with impact surface 131 of adapter sub 136, as indicated by an indication arrow 154 in FIG. 5*b*.

In another situation, piston 124 is in the engaged position, as shown in FIG. 4*b*, so that drive chamber 141 is in fluid communication with return exhaust ports 142*a* and 142*b*. In this way, the fluid in drive chamber 141 is capable of flowing from drive chamber 141 to the region external to hammer assembly 103. Further, return chamber 140 is in fluid communication with central channel 112 through drive piston ports 122*c* and 122*d* through drive guide ports 132*c* and 132*d*, respectively. In this way, the fluid flowing through central channel 112 provided by drill string opening 108 is capable of flowing into return chamber 140. As the fluid flows into return chamber 140, its pressure increases, which applies a force to return surface 130 of piston body 126 and moves piston body 126 along sleeve portion 123 towards head portion 121.

Piston body 126 moves, in response to overstrike force F applied to return surface 130, away from adapter sub 136, wherein return surface 130 is disengaged from impact surface 131. Adapter sub 136 slides relative to drive chuck 134 in response to return surface 130 being disengaged from impact surface 131. As mentioned above, rotary earth bit 102 is coupled to adapter sub 136. Hence, rotary earth bit 102 also slides in response to return surface 130 being disengaged from impact surface 131, wherein rotary earth bit slides so it is moved from the extended position (FIG. 5*b*) to the retracted position (FIG. 5*a*). In the retracted position, adapter sub 136 is engaged with drive chuck 134, as discussed in more detail above.

In another embodiment, piston body 126 moves away from adapter sub 136 as a result of a rebound, wherein the rebound includes the portion of the impact energy not transmitted through adapter sub 136 and earth bit 102 to the formation. In this embodiment, adapter sub 136 moves relative to drive chuck 134 in response to the impact of piston body 126 with the surface 131 of adapter sub 136. In this way, overstrike force F is imparted to adapter sub 136 and the motion of piston body 126 is in response to a reaction force applied to it by adapter sub 136.

Hence, piston 124 is moved between the engaged and disengaged positions by adjusting the fluid pressure in return chamber 140 and drive chamber 141. The fluid pressure in return chamber 140 and drive chamber 141 is adjusted so that oscillating forces are applied to return surface 130 and drive surface 128 and piston 124 is moved towards and away from impact surface 131.

Rotary earth bit 102 typically operates with a threshold inlet pressure of about 40 pounds per square inch (psi). However, most drilling machines provide a supply pressure of between about 50 psi to 100 psi. Hence, only about 10 psi to 60 psi will be available to operate hammer assembly 103 if hammer assembly 103 and rotary earth bit 102 are coupled together in series. In accordance with the invention, hammer assembly 103 is capable of operating at full system pressure so that piston 124 can apply more percussive power to adapter sub 136 and rotary earth bit 102. Hence, the fluid pressure at which hammer assembly 103 operates is driven to equal the fluid pressure at which rotary earth bit 102 operates.

As mentioned above, drill string 106 provides fluids to hammer assembly 103 through drill string opening 108, and the fluids can be of many different types, such as air or other gases, or a combination of gases and liquids, such as oil and/or water. In one embodiment, the fluid includes air and the air is flowed through drill string 106 at a rate less than about 5,000 cubic feet per minute (cfm). For example, in one embodiment, the air is flowed at a rate in a range of about 1,000 cfm to about 4,000 cfm. In another embodiment, the fluid includes air and the air flowed through drill string 106 is provided at an air pressure less than about one-hundred pounds per square inch (100 psi). For example, in one embodiment, the pressure of the air flowing through drill string 106 is at a pressure in a range of about 40 psi to about 100 psi. In another embodiment, the pressure of the air flowing through drill string 106 is at a pressure in a range of about 40 psi to about 80 psi. In accordance with the invention, the pressure of the air used to operate hammer assembly 103 is driven to equal the pressure of the air used to operate rotary earth bit 102. In general, the penetration rate of earth bit 102 increases and decreases as the air pressure increases and decreases, respectively.

Overstrike force F is typically applied to earth bit 102 with an amplitude and frequency. When overstrike force F is applied to earth bit 102 with a frequency, its amplitude changes as a function of time. In this way, overstrike force F is a time-varying overstrike force. The frequency of overstrike force F is typically periodic, although it can be non-periodic in some situations. The frequency of overstrike force F corresponds with the number of times that piston 124 impacts adapter sub 136. As mentioned above, the magnitude of overstrike force F typically corresponds with the absolute value of the amplitude of overstrike force F.

Overstrike force F can have magnitude values in many different ranges. However, overstrike force F is typically less than about five foot-pounds per square inch (5 ft-lb/in$^2$). In one embodiment, overstrike force F is in a range of about 1 ft-lb/in$^2$ to about 4 ft-lb/in$^2$. In one embodiment, overstrike force F is in a range of about 1 ft-lb/in$^2$ to about 5 ft-lb/in$^2$. In another embodiment, overstrike force F is in a range of about 1.2 ft-lb/in$^2$ to about 3.6 ft-lb/in$^2$. In general, the penetration rate of earth bit 102 increases and decreases as overstrike force F increases and decreases, respectively. However, it is typically undesirable to apply an overstrike force to earth bit 102 with a value that will damage earth bit 102. It should be noted that the area over which overstrike force F is applied can be many different areas. For example, in one embodiment, the area over which overstrike force F is applied corresponds to the area of impact surface 131 of adapter sub 136 (FIG. 3*f*).

The frequency of overstrike force F can have many different values. For example, in one embodiment, overstrike force F is applied to earth bit 102 at a rate less than about 1500 times per minute. In one particular embodiment, overstrike force F is applied to earth bit 102 at a rate in a range of about 1100 times per minute to about 1400 times per minute.

The frequency and amplitude of overstrike force F can be adjusted. The frequency and amplitude of overstrike force F can be adjusted for many different reasons, such as to adjust the penetration rate of earth bit 102 into the formation. In one embodiment, the amplitude and/or frequency of overstrike force F are adjusted in response to an indication of a penetration rate of earth bit 102 through the formation. The indication of the penetration rate of earth bit 102 through the formation can be provided in many different ways. For example, the penetration rate of earth bit 102 through the formation is typically monitored with equipment included with the drilling machine.

The penetration rate of earth bit 102 through the formation is adjusted by adjusting at least one of an amplitude and frequency of overstrike force F. For example, in one embodiment, the penetration rate of earth bit 102 through the formation is adjusted by adjusting the amplitude of overstrike force F. In another example, the penetration rate of earth bit 102 through the formation is adjusted by adjusting the frequency of overstrike force F. In another example, the penetration rate of earth bit 102 through the formation is adjusted by adjusting the frequency and amplitude of overstrike force F.

In one embodiment, the amplitude of overstrike force F is adjusted in response to the indication of the penetration rate of earth bit 102 through the formation. In another embodiment, the frequency of overstrike force F is adjusted in response to the indication of the penetration rate of earth bit 102 through the formation. In one embodiment, the frequency and amplitude of overstrike force F are both adjusted in response to the indication of the penetration rate of earth bit 102 through the formation. In this way, overstrike force F is adjusted in response to an indication of a penetration rate of earth bit 102 through the formation.

In general, overstrike force F is adjusted to drive the penetration rate of earth bit 102 through the formation to a desired penetration rate. The frequency and/or amplitude of the overstrike force are typically increased to increase the penetration rate of earth bit 102 through the formation. Further, the frequency and/or amplitude of the overstrike force are typically decreased to decrease the penetration rate of earth bit 102 through the formation. Further, overstrike force F is typically adjusted to reduce the likelihood of earth bit 102 experiencing any damage.

The frequency and amplitude of overstrike force F can be adjusted in many different ways. In one embodiment, the frequency and amplitude of overstrike force F are adjusted in response to adjusting the fluid flow through drill string 106. The frequency and amplitude of overstrike force F are typically increased and decreased in response to increasing and decreasing, respectively, the fluid flow through drill string 106. For example, in one embodiment, the frequency and amplitude of overstrike force F are increased and decreased in response to increasing and decreasing, respectively, the pressure of the air flowing through drill string 106.

It should be noted that, in some embodiments, the frequency and amplitude of overstrike force F are adjusted automatically by the equipment of the drilling machine by adjusting the fluid flow. In other embodiments, the fluid flow is adjusted manually to adjust the frequency and amplitude of overstrike force F.

The material being exhausted from drive chamber 141 and return chamber 140 can be flowed to the external region of hammer assembly 103 in many different ways, one of which is shown in FIG. 6. In this embodiment, the exhaust flows through drive exhaust ports 142*a* and 142*b* and return exhaust ports 142*c* and 142*d* and into an exhaust annulus 117. It should be noted that exhaust annulus 117 extends radially around the outer periphery of hammer casing body 110. The exhaust flows from exhaust annulus 117 to a hammer assembly exhaust port 119, which extends through backhead 114. When the pressure of the fluid within exhaust annulus 117 and hammer assembly exhaust port 119 reaches a predetermined threshold pressure level, check valve 115 opens to relieve it. When the pressure of the fluid within exhaust annulus 117 and hammer assembly exhaust port 119 is below the predetermined threshold pressure level, check valve 115 remains closed so it is not relieved. The predetermined threshold pressure level can be adjusted in many different ways, such as by replacing check valve 115 with another check valve having a different threshold pressure level. Check valve 115 can be easily replaced because it is positioned towards the rearward end of hammer assembly 103.

As discussed above, overstrike force F is applied by piston 124 to rotary earth bit 102 through adapter sub 136. The magnitude of overstrike force F can be controlled in many different ways. In one way, the amount of overstrike force is controlled by choosing adapter sub 136 to have a desired mass. As the mass of adapter sub 136 increases, less overstrike force is transferred from piston 124 to rotary earth bit 102 in response to return surface 130 engaging impact surface 131. Further, as the mass of adapter sub 136 decreases, more overstrike force is transferred from piston 124 to rotary earth bit 102 in response to return surface 130 engaging impact surface 131. Another way the amount of overstrike force is controlled is by choosing piston 124 to have a desired mass. As the mass of piston 124 is increased, more of the overstrike force is transferred by it to rotary earth bit 102. Further, as the mass of piston 124 is decreased, less of the overstrike force is transferred from it to rotary earth bit 102.

The overstrike force applied by piston 124 can be controlled by controlling the size of cylinder 113. As the size of cylinder 113 increases, the overstrike force increases because piston 124 is moved over a longer distance before engaging adapter sub 136. As the size of cylinder 113 decreases, the overstrike force decreases because piston 124 is moved over a shorter distance before engaging adapter sub 136.

Overstrike force F applied by piston 124 can be controlled by controlling the size of drive chamber 141. As the size of drive chamber 141 increases, overstrike force F increases because the pressure of the fluid in drive chamber 141 increases more gradually, which increases the length of travel of piston 124. A longer length of travel allows the pressure of the fluid of drive chamber 141 to increasingly accelerate piston 124, which increases overstrike force F. As the size of drive chamber 141 decreases, overstrike force F decreases because the upward motion of piston 124 is retarded by a more rapidly increasing pressure of the fluid of drive chamber 141, which shortens the length of piston travel and overstrike force F.

Overstrike force F applied by piston 124 can also be controlled by controlling the size of return chamber 140. As the size of return chamber 140 increases, overstrike force F increases because the pressure of the fluid of return chamber 140 increases more gradually on the forward stroke of piston 124, which allows greater acceleration of piston 124. As the size of return chamber 140 decreases, overstrike force F decreases because the more rapidly increasing pressure of the fluid of return chamber 140 increasingly decelerates piston 124, which reduces overstrike force F.

The overstrike force applied by piston 124 can be controlled by controlling the size of drive guide ports 122*a* and 122*b*. As the size of drive guide ports 122*a* and 122*b* increase, piston 124 applies a larger overstrike force to adapter sub 136 because more fluid can flow at a faster rate from central channel 112 to drive chamber 141. As the size of drive guide ports 122*a* and 122*b* decrease, piston 124 applies a smaller overstrike force to adapter sub 136 because less fluid can flow at a slower rate from central channel 112 to drive chamber 141.

The frequency of overstrike force F applied by piston 124 to rotary earth bit 102 through adapter sub 136 can be controlled in many different ways. The frequency of overstrike force F increases as overstrike force F is applied by piston 124 to rotary earth bit 102 more often, and the frequency of overstrike force F decreases as overstrike force F is applied by piston 124 to rotary earth bit 102 less often.

The frequency that overstrike force F is applied to adapter sub 136 can be controlled by controlling the size of return guide ports 122*c* and 122*d*. As the size of return guide ports 122*c* and 122*d* increase, the frequency increases because fluid from central channel 112 can be flowed into return chamber 140 at a faster rate. As the size of return guide ports 122*c* and 122*d* decrease, the frequency decreases because fluid from central channel 112 can be flowed into return chamber 140 at a slower rate.

The frequency that overstrike force F is applied to adapter sub 136 can be controlled by controlling the size of return exhaust ports 142*c* and 142*d*. As the size of return exhaust ports 142*c* and 142*d* increase, the frequency increases because fluid from return chamber 140 can be flowed out of return chamber 140 at a faster rate. As the size of return exhaust ports 142*c* and 142*d* decrease, the frequency decreases because fluid from return chamber 140 can be flowed out of return chamber 140 at a slower rate.

Hammer assembly 103 provides many advantages. One advantage provided by hammer assembly 103 is that piston 124 applies low energy and high frequency power to rotary earth bit 102. This is useful to reduce the amount of stress experienced by rotary earth bit 102. Another advantage provided by hammer assembly 103 is that there are parallel supply and exhaust flow paths which enable improved air and power control without having to increase the pressure of the fluid provided by drill string 106. Further, the amount of power provided by hammer assembly 103 to rotary earth bit 102 can be adjusted by adjusting throttle plate 116 and/or check valve 115. In this way, the amount of power provided by hammer assembly 103 can be adjusted without having to adjust the pressure of the fluid provided by drill string 106. Another advantage is that the exhaust of hammer assembly 103 is flowed out of hammer assembly 103 towards its rearward end and is directed upwardly through borehole 105. In this way, the exhaust of hammer assembly 103 assists in clearing debris from borehole 105.

Figure 7A:
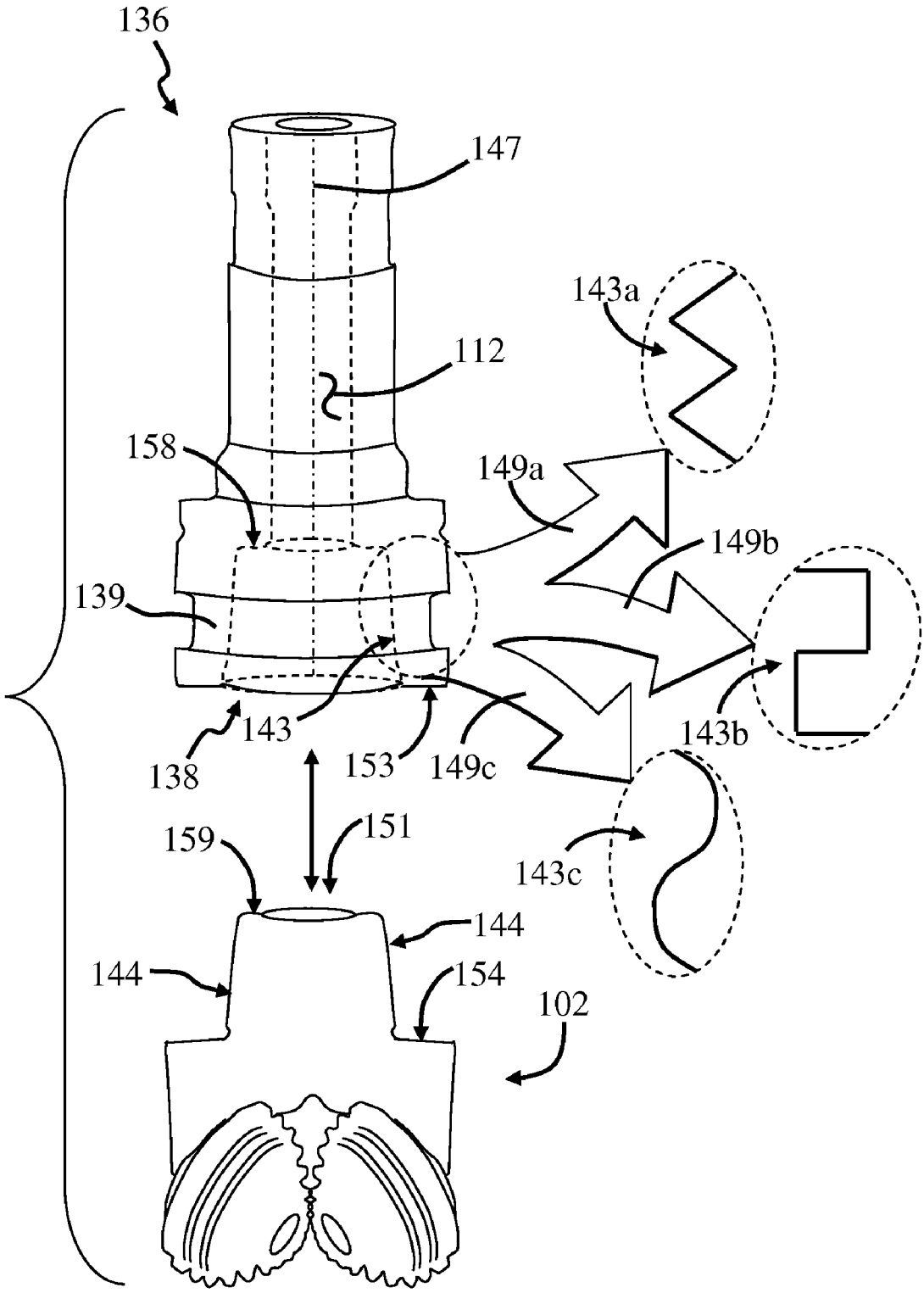
FIG. 7*a* is a perspective view of the adapter sub and rotary earth bit of FIGS. 2*a* and 2*b* in a decoupled condition.

FIG. 7*a* is a perspective view of adapter sub 136 and rotary earth bit 102 in a decoupled condition. Adapter sub 136 and rotary earth bit 102 are in a coupled condition in FIGS. 2*a* and 2*b*. Adapter sub 136 and rotary earth bit 102 are in the decoupled condition when they are decoupled from each other. Further, adapter sub 136 and rotary earth bit 102 are in the coupled condition when they are coupled to each other.

Adapter sub 136 and rotary earth bit 102 are repeatably moveable between the coupled and decoupled conditions. Rotary earth bit 102 can be coupled to adapter sub 136 in many different ways. In this embodiment, tool joint 139 and rotary earth bit 102 include trapezoidal tool joint threads 143 and trapezoidal rotary earth bit threads 144, respectively. Adapter sub 136 and rotary earth bit 102 are moved to the coupled condition by threadingly engaging trapezoidal tool joint threads 143 and trapezoidal rotary earth bit threads 144. Further, adapter sub 136 and rotary earth bit 102 are moved to the decoupled condition by threadingly disengaging trapezoidal tool joint threads 143 and trapezoidal rotary earth bit threads 144. In this way, adapter sub 136 and rotary earth bit 102 are repeatably moveable between coupled and decoupled conditions.

It should be noted that a central channel 151 of rotary earth bit 102 is in fluid communication with central channel 112 when rotary earth bit 102 and adapter sub 136 are coupled to each other. In this way, fluid flows from drill string 106 through drill string nozzle 108 and central channel 112 to central channel 151 of rotary earth bit 102 (FIGS. 2*a* and 2*b*). It should also be noted that an annular surface 159 extends around an opening of central channel 151 that faces adapter sub 136. Further, an annular surface 158 extends around an opening of central channel 112 that faces rotary earth bit 102. Annular faces 158 and 159 face each other when rotary earth bit 102 and adapter sub 136 are in the coupled condition. In some embodiments, annular surfaces 158 and 159 are spaced apart from each other and, in other embodiments, annular surfaces 158 and 159 are engaged with each other, as will be discussed in more detail below.

The threads of adapter sub 136 and rotary earth bit 102 are complementary to each other, which allows rotary earth bit 102 and adapter sub 136 to be repeatably moveable between coupled and decoupled conditions. Adapter sub 136 and rotary earth bit 102 can include many other types of threads besides trapezoidal threads. For example, as indicated by an indication arrow 149*a*, adapter sub 136 can include v-shaped threads 143*a* and rotary earth bit 102 can include complementary v-shaped threads. As indicated by an indication arrow 149*b*, adapter sub 136 can include buttressed threads 143*b* and rotary earth bit 102 can include complementary buttressed threads. Further, as indicated by an indication arrow 149*c*, adapter sub 136 can include rope threads 143*c* and rotary earth bit 102 can include complementary rope threads. More information regarding threads that can be included with rotary earth bit 102 and adapter sub 136 is provided in U.S. Pat. Nos. 3,259,403, 3,336,992, 4,600,064, 4,760,887 and 5,092,635, as well as U.S. Patent Application Nos. 20040251051, 20070199739 and 20070102198.

Figure 7B:
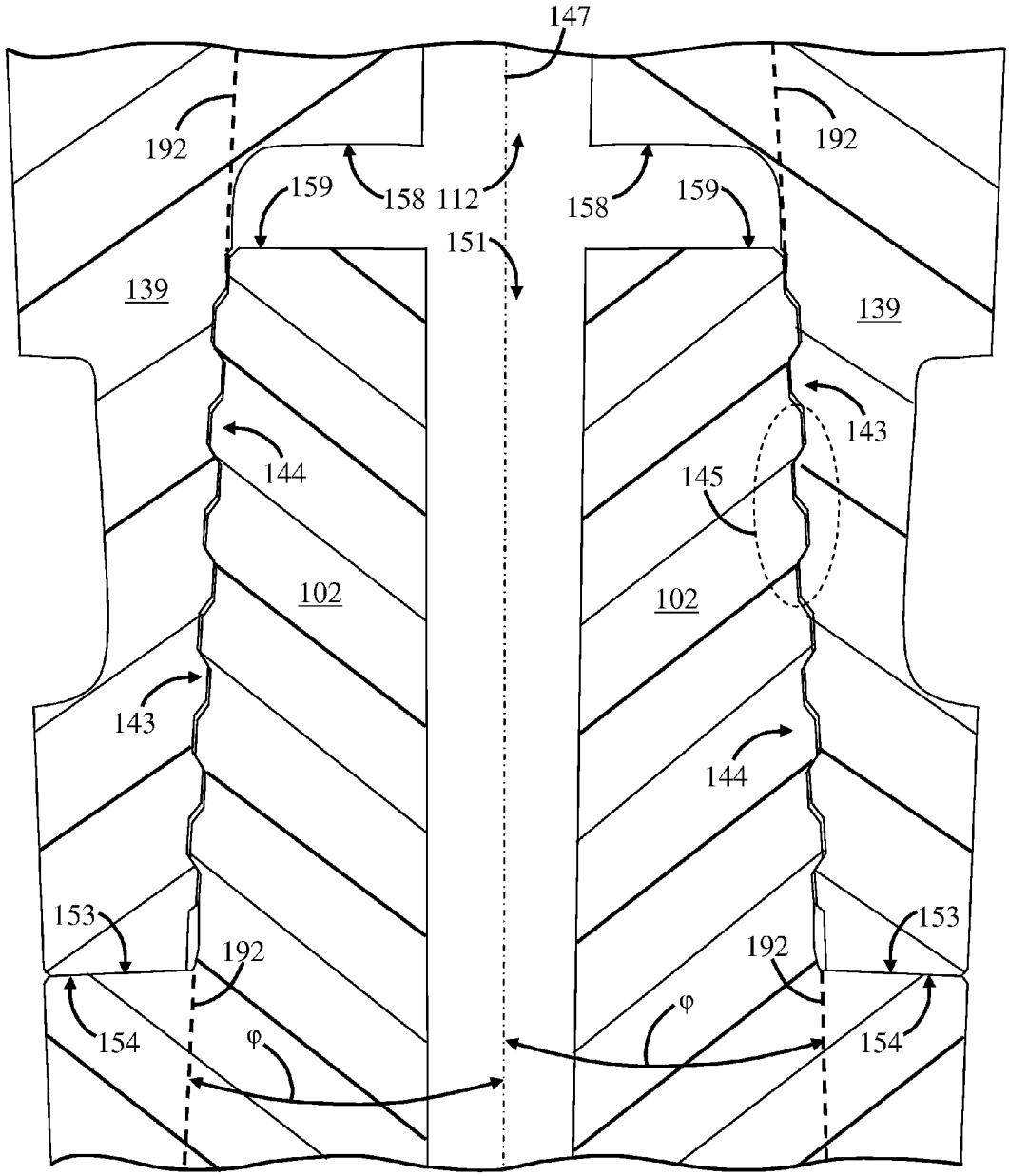
FIGS. 7*b* and 7*c* are cross-sectional views of adapter sub and rotary earth bit of FIGS. 2*a* and 2*b* in coupled conditions.

FIG. 7*b* is a cross-sectional view of adapter sub 136 and rotary earth bit 102 in coupled conditions. In this embodiment, a reference line 192 extends through tool joint threads 143 and rotary earth bit threads 144 when tool joint 139 and rotary earth bit 102 are in the coupled condition, wherein reference line 192 is at an angle $\phi$ relative to centerline 147. In this way, tool joint 139 includes a threaded surface which extends at angle $\phi$ relative to centerline 147. Tool joint 139 is included with adapter sub 136 so that adapter sub 136 includes a threaded surface which extends at angle $\phi$ relative to centerline 147. Further, rotary earth bit 102 includes a threaded surface which extends at angle $\phi$ relative to centerline 147.

Angle $\phi$ can have many different angular values. In some embodiments, angle $\phi$ is in a range between about one degree (1°) to about nine degrees (9°). In some embodiments, angle $\phi$ is in a range between about one and one-half degrees (1.5°) to about eight degrees (8°). In some embodiments, angle $\phi$ is in a range between about three degrees (3°) to about five degrees (5°). In one particular embodiment, angle $\phi$ is about four and three-quarters of a degree (4.75°).

Angle $\phi$ is generally chosen so that rotary earth bit 102 is aligned with adapter sub 136 in response to moving rotary earth bit 102 and adapter sub 136 from the disengaged condition to the engaged condition. In this way, rotary earth bit 102 experiences less wobble in response to the rotation of hammer assembly 103 and drill string 106. It should be noted that the value of angle $\phi$ affects the amount of rotational energy transferred between drill string 106 and rotary earth bit 102 through adapter sub 136. The amount of rotational energy transferred between drill string 106 and rotary earth bit 102 increases and decreases as the value of angle $\phi$ increases and decreases, respectively.

In this embodiment, annular surfaces 158 and 159 are spaced apart from each other in response to rotary earth bit 102 and adapter sub 136 being in the coupled condition. Annular surfaces 158 and 159 are spaced apart from each other so that overstrike force F does not flow between adapter sub 136 and rotary earth bit 102 through annular surfaces 158 and 159. Instead, a first portion of overstrike force F flows between adapter sub 136 and rotary earth bit 102 through trapezoidal tool joint threads 143 and trapezoidal rotary earth bit threads 144.

Adapter sub 136 and rotary earth bit 102 are coupled to each other so that radial surfaces 153 and 154 (FIGS. 7*a* and 7*b*) engage each other and form an interface therebetween. Surfaces 153 and 154 are radial surfaces because they extend radially relative to centerline 147. Radial surfaces 153 and 154 engage each other so that a second portion of overstrike force F flows between adapter sub 136 and rotary earth bit 102 through surfaces 153 and 154.

It should be noted that overstrike force F flows more efficiently between adapter sub 136 and rotary earth bit 102 through surfaces 153 and 154 than through trapezoidal tool joint threads 143 and trapezoidal rotary earth bit threads 144. Overstrike force F experiences more attenuation in response to flowing through trapezoidal tool joint threads 143 and trapezoidal rotary earth bit threads 144 than through surfaces 153 and 154. Overstrike force F experiences less attenuation in response to flowing through surfaces 153 and 154 than through trapezoidal tool joint threads 143 and trapezoidal rotary earth bit threads 144. In this way, overstrike force F flows more efficiently through surfaces 153 and 154 than through trapezoidal tool joint threads 143 and trapezoidal rotary earth bit threads 144.

It should be noted, however, that the efficiency in which overstrike force F flows through trapezoidal tool joint threads 143 and trapezoidal rotary earth bit threads 144 increases and decreases as angle $\phi$ increases and decreases, respectively. It should also be noted that the interface between adapter sub 136 and rotary earth bit 102 can have many other shapes, one of which will be discussed in more detail presently.

Figure 7C:
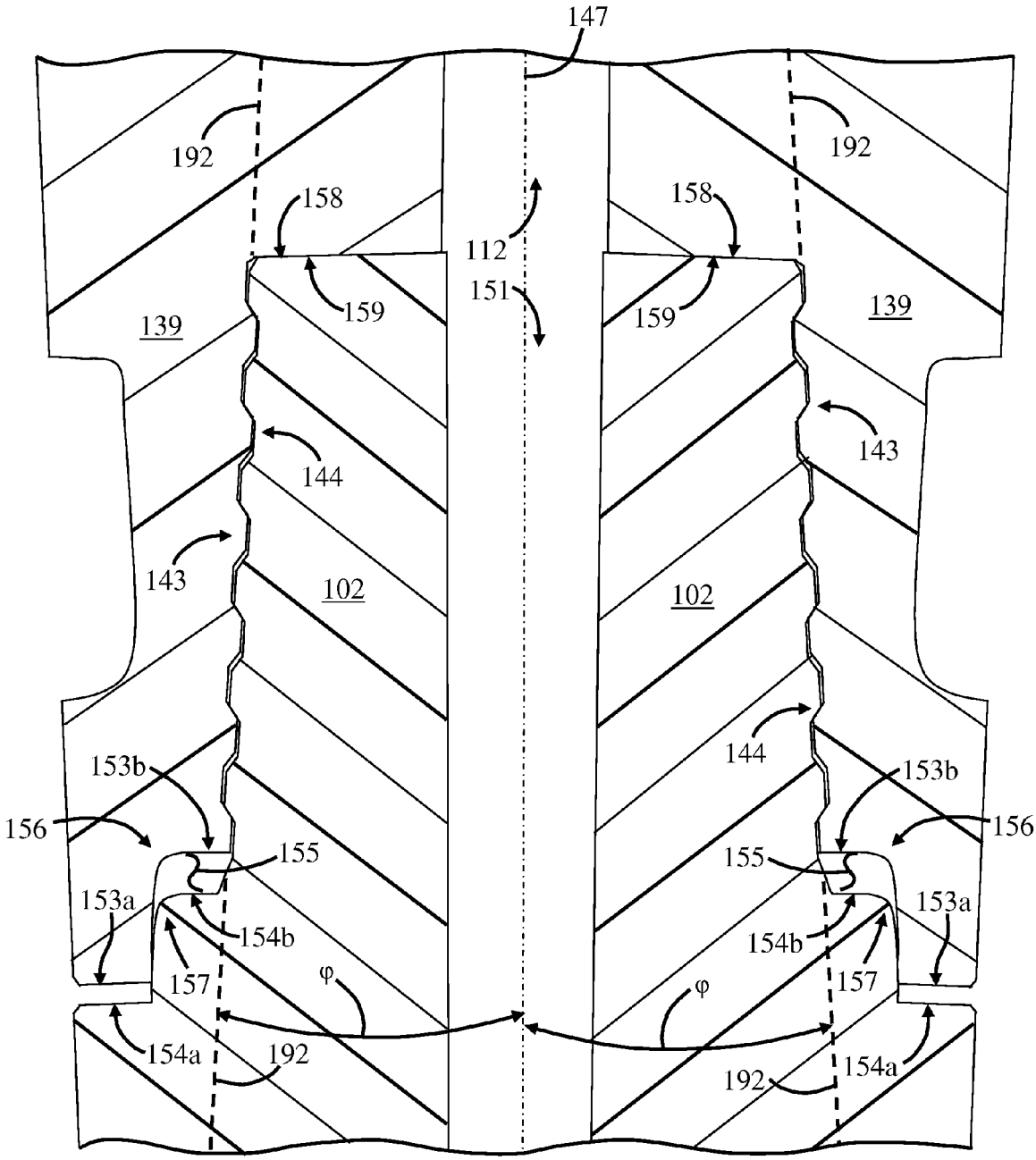

FIG. 7*c* is a cross-sectional view of adapter sub 136 and rotary earth bit 102 in coupled conditions. In this embodiment, annular surfaces 158 and 159 are engaged with each other in response to rotary earth bit 102 and adapter sub 136 being in the coupled condition. Annular surfaces 158 and 159 are engaged with each other so that a third portion of overstrike force F does flow between adapter sub 136 and rotary earth bit 102 through annular surfaces 158 and 159. As mentioned above, the first portion of overstrike force F flows between adapter sub 136 and rotary earth bit 102 through trapezoidal tool joint threads 143 and trapezoidal rotary earth bit threads 144.

In this embodiment, adapter sub 136 and rotary earth bit 102 are coupled to each other so that an outer radial surface 153*a* faces an outer radial surface 154*a* and, and an outer radial surface 153*b* faces an outer radial surface 154*b*. Surfaces 153*a*, 153*b*, 154*a* and 154*b* are radial surfaces because they extend radially relative to centerline 147. Further, surfaces 153*a* and 154*a* are outer surfaces because they are positioned away from centerline 147. Surfaces 153*a* and 154*a* are positioned away from centerline 147 because they are positioned further away from centerline 147 than surfaces 153*b* and 154*b*. Surfaces 153*b* and 154*b* are inner surfaces because they are positioned towards centerline 147. Surfaces 153*b* and 154*b* are positioned towards centerline 147 because they are positioned closer to centerline 147 than surfaces 153*a* and 154*a*.

Surfaces 153*a* and 153*b* are spaced apart from each other to form an annular shoulder 156, and surfaces 154*a* and 154*b* are spaced apart from each other to form an annular shoulder 157. Annular shoulders 156 and 157 are positioned towards inner surfaces 153*b* and 154*b*, respectively. Annular shoulders 156 and 157 are positioned away from inner surfaces 153*a* and 154*a*, respectively. Inner surfaces 153*b* and 154*b* are spaced apart from each other, and annular shoulders 156 and 157 are spaced apart from each other to form an annular groove 155.

Surfaces 153*a* and 154*a* are spaced apart from each other when adapter sub 136 and rotary earth bit 102 are in the engaged condition, so that overstrike force F does not flow between adapter sub 136 and rotary earth bit 102 through surfaces 153*a* and 154*a*. In this way, overstrike force F is restricted from flowing between adapter sub 136 and rotary earth bit 102 through surfaces 153*a* and 154*a*. Further, surfaces 153*b* and 154*b* are spaced apart from each other when adapter sub 136 and rotary earth bit 102 are in the engaged condition, so that overstrike force F does not flow between adapter sub 136 and rotary earth bit 102 through surfaces 153*b* and 154*b*. In this way, overstrike force F is restricted from flowing between adapter sub 136 and rotary earth bit 102 through surfaces 153*b* and 154*b*.

Overstrike force F flows more efficiently between adapter sub 136 and rotary earth bit 102 through surfaces 158 and 159 than through trapezoidal tool joint threads 143 and trapezoidal rotary earth bit threads 144. Overstrike force F experiences more attenuation in response to flowing through trapezoidal tool joint threads 143 and trapezoidal rotary earth bit threads 144 than through surfaces 158 and 159. Overstrike force F experiences less attenuation in response to flowing through surfaces 158 and 159 than through trapezoidal tool joint threads 143 and trapezoidal rotary earth bit threads 144. In this way, overstrike force F flows more efficiently through surfaces 158 and 159 than through trapezoidal tool joint threads 143 and trapezoidal rotary earth bit threads 144.

Figure 7D:
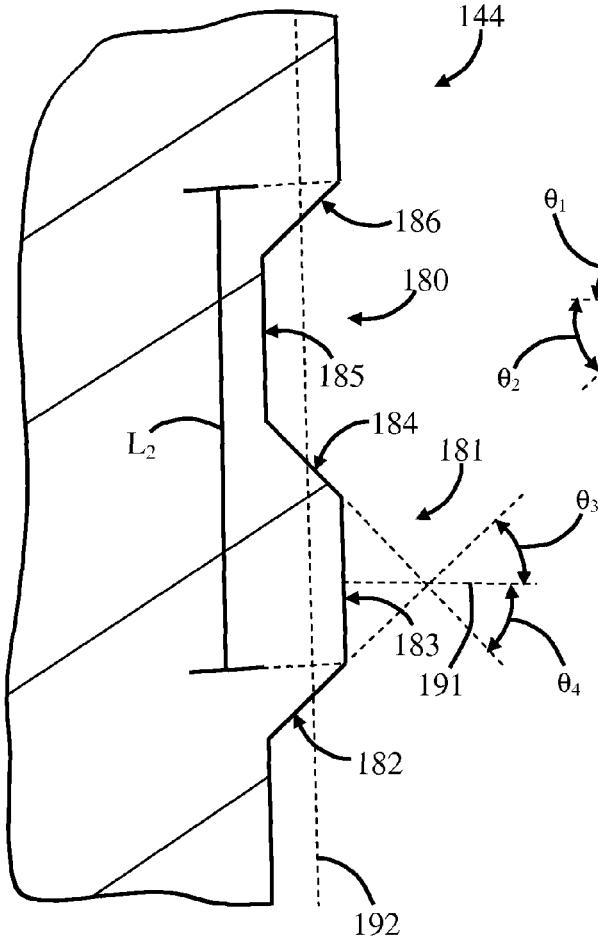
FIG. 7*d* is a side view of trapezoidal rotary earth bit threads of the rotary earth bit of FIGS. 2*a* and 2*b*.
Figure 7E:
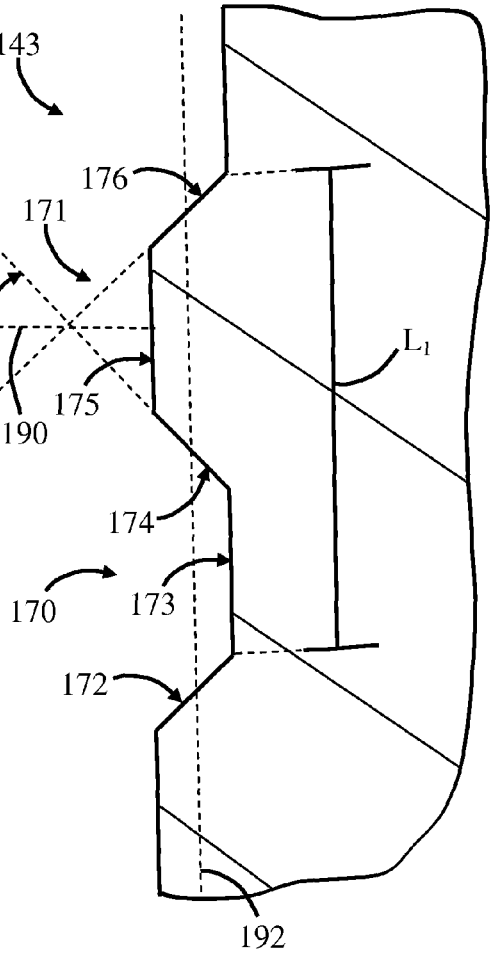
FIG. 7*e* is a side view of trapezoidal tool joint threads of the adapter sub of FIGS. 2*a* and 2*b*.

FIG. 7*d* is a side view of trapezoidal rotary earth bit threads 144 in a region 145 of FIG. 7*b*, and FIG. 7*e* is a side view of trapezoidal tool joint threads 143 in region 145 of FIG. 7*b*. In region 145 of FIG. 7*b*, trapezoidal tool joint threads 143 and trapezoidal rotary earth bit threads 144 are threadingly engaged together.

As shown in FIG. 7*d*, rotary earth bit threads 144 includes an earth bit thread root 180 and earth bit thread crest 181. In this embodiment, earth bit thread root 180 includes a longitudinal wall 185 and tapered sidewalls 184 and 186. Tapered sidewalls 184 and 186 extend from opposed ends of longitudinal wall 185 and towards centerline 147 (FIG. 7*b*). Longitudinal wall 185 is parallel to longitudinal reference line 192, and perpendicular to a radial reference line 191. Longitudinal wall 185 extends at angle $\phi$ relative to centerline 147.

In this embodiment, earth bit thread root 180 includes a longitudinal wall 183 and tapered sidewall 182. Tapered sidewall 182 extends from an end of longitudinal wall 185 opposed to tapered sidewall 184 and towards centerline 147 (FIG. 7*d*). Longitudinal wall 183 is parallel to longitudinal reference line 192 and longitudinal wall 185, and perpendicular to a radial reference line 191. Longitudinal wall 183 extends at angle $\phi$ relative to centerline 147. The tapered sidewalls of trapezoidal rotary earth bit threads 144 extend at a non-parallel angle relative to longitudinal reference line 192, as will be discussed in more detail below.

Rotary earth bit threads 144 have a pitch $L_2$, wherein pitch $L_2$ is a length along longitudinal reference line 192 that earth bit thread root 180 and earth bit thread crest 181 extend. More information regarding the pitch of a thread can be found in the above-referenced U.S. Patent Application No. 20040251051. As pitch $L_2$ increases and decreases the number of threads per unit length of trapezoidal rotary earth bit threads 144 increases and decreases, respectively. As pitch $L_2$ increases and decreases the number of earth bit thread roots 180 per unit length increases and decreases, respectively. Further, as pitch $L_2$ increases and decreases the number of earth bit thread crests 181 per unit length increases and decreases, respectively.

Thread pitch $L_2$ can have many different length values. In some embodiments, thread pitch $L_2$ has a length value in a range between about one-quarter of an inch to about one inch. In some embodiments, thread pitch $L_2$ has a length value in a range between about one-half of an inch to about one inch. In one particular, embodiment, thread pitch $L_2$ has a length value of one-eighth of an inch.

As mentioned above, the tapered sidewalls of trapezoidal rotary earth bit threads 144 extend at a non-parallel angle relative to longitudinal reference line 192. For example, in this embodiment, tapered sidewall 182 extends at an angle $\theta_3$ relative to radial reference line 191. Further, tapered sidewall 184 extends at an angle $\theta_4$ relative to radial reference line 161. It should be noted that the tapered sidewalls of trapezoidal rotary earth bit threads 144 extend at the same angle magnitude relative to longitudinal reference line 192.

Angles $\theta_3$ and $\theta_4$ can have many different angular values. In some embodiments, angles $\theta_3$ and $\theta_4$ are in a range between about one degree (1°) to about nine degrees (9°) In some embodiments, angles $\theta_3$ and $\theta_4$ are in a range between about one and one-half degrees (1.5°) to about eight degrees (8°). In some embodiments, angles $\theta_3$ and $\theta_4$ are in a range between about three degrees (3°) to about five degrees (5°). In one particular embodiment, angles $\theta_3$ and $\theta_4$ are each equal to about four and three-quarters of a degree (4.75°). In some embodiments, angles $\theta_3$ and $\theta_4$ are equal to each other and, in other embodiments, angles $\theta_3$ and $\theta_4$ are not equal to each other. In some embodiments, angles $\theta_3$ and $\theta_4$ are each equal to angle $\phi$ and, in other embodiments, angles $\theta_3$ and $\theta_4$ are not equal to angle $\phi$. It should be noted that the values for angles $\theta_3$ and $\theta_4$ are not shown to scale in FIG. 7*d*.

In general, angles $\theta_3$ and $\theta_4$ are chosen to reduce the likelihood that rotary earth bit 102 and adapter sub 136 will over-tighten with each other. Further, angles $\theta_3$ and $\theta_4$ are chosen to increase the efficiency in which overstrike force F is transferred from hammer assembly 103 to rotary earth bit 102 through adapter sub 136. In general, the efficiency in which overstrike force F is transferred from hammer assembly 103 to rotary earth bit 102 through adapter sub 136 increases and decreases as angles $\theta_3$ and $\theta_4$ decrease and increase, respectively.

It should be noted that the helix angle of trapezoidal rotary earth bit threads 144 can have many different angular values. More information regarding the helix angle of a thread can be found in the above-references U.S. Patent Application No. 20040251051. In some embodiments, the helix angle of trapezoidal rotary earth bit threads 144 is in a range between about one degree (1°) to about ten degrees (10°). In some embodiments, the helix angle of trapezoidal rotary earth bit threads 144 is in a range between about one and one-half degrees (1.5°) to about five degrees (5°). In one particular embodiment, the helix angle of trapezoidal rotary earth bit threads 144 is about two and one-half degrees (2.5°).

As shown in FIG. 7*e*, trapezoidal tool joint threads 143 includes a tool joint thread root 170 and tool joint thread crest 171. In this embodiment, tool joint thread root 170 includes a longitudinal wall 175 and tapered sidewalls 174 and 176. Tapered sidewalls 174 and 176 extend from opposed ends of longitudinal wall 175 and towards centerline 147 (FIG. 7*b*). Longitudinal wall 175 is parallel to longitudinal reference line 192, and perpendicular to a radial reference line 191. Longitudinal wall 175 extends at angle $\phi$ relative to centerline 147.

In this embodiment, tool joint thread root 170 includes a longitudinal wall 173 and tapered sidewall 172. Tapered sidewall 172 extends from an end of longitudinal wall 175 opposed to tapered sidewall 174 and towards centerline 147 (FIG. 7*b*). Longitudinal wall 173 is parallel to longitudinal reference line 192 and longitudinal wall 175, and perpendicular to radial reference line 191. Longitudinal wall 173 extends at angle $\phi$ relative to centerline 147. The tapered sidewalls of trapezoidal tool joint bit threads 143 extend at a non-parallel angle relative to longitudinal reference line 192, as will be discussed in more detail below.

Trapezoidal tool joint threads 143 have a pitch $L_1$, wherein pitch $L_1$ is a length along longitudinal reference line 192 that tool joint thread root 170 and tool joint thread crest 171 extend. As pitch $L_1$ increases and decreases the number of threads per unit length of trapezoidal tool joint threads 143 increases and decreases, respectively. As pitch $L_1$ increases and decreases the number of tool joint thread roots 170 per unit length increases and decreases, respectively. Further, as pitch $L_1$ increases and decreases the number of tool joint thread crests 171 per unit length increases and decreases, respectively.

Thread pitch $L_1$ can have many different length values. In some embodiments, thread pitch $L_1$ has a length value in a range between about one-quarter of an inch to about one inch. In some embodiments, thread pitch $L_1$ has a length value in a range between about one-half of an inch to about one inch. In one particular, embodiment, thread pitch $L_1$ has a length value of one-eighth of an inch. It should be noted that thread pitches $L_1$ and $L_2$ are generally the same to facilitate the ability to repeatably move adapter sub 136 and rotary earth bit 102 between coupled and decoupled conditions.

As mentioned above, the tapered sidewalls of trapezoidal tool joint threads 143 extend at a non-parallel angle relative to longitudinal reference line 192. For example, in this embodiment, tapered sidewall 174 extends at an angle $\theta_1$ relative to radial reference line 190. Further, tapered sidewall 176 extends at an angle $\theta_2$ relative to radial reference line 190. It should be noted that the tapered sidewalls of trapezoidal tool joint threads 143 extend at the same magnitude angle relative to longitudinal reference line 192. Further, the tapered sidewalls of trapezoidal tool joint threads 143 generally extend at the same magnitude angle relative to longitudinal reference line 192 as the tapered sidewalls of trapezoidal rotary earth bit threads 144 to facilitate the ability to repeatably move adapter sub 136 and rotary earth bit 102 between coupled and decoupled conditions.

Angles $\theta_1$ and $\theta_2$ can have many different angular values. In some embodiments, angles $\theta_1$ and $\theta_2$ are in a range between about one degree (1°) to about nine degrees (9°) In some embodiments, angles $\theta_1$ and $\theta_2$ are in a range between about one and one-half degrees (1.5°) to about eight degrees (8°). In some embodiments, angles $\theta_1$ and $\theta_2$ are in a range between about three degrees (3°) to about five degrees (5°). In one particular embodiment, angles $\theta_1$ and $\theta_2$ are each equal to about four and three-quarters of a degree (4.75°). In some embodiments, angles $\theta_1$ and $\theta_2$ are equal to each other and, in other embodiments, angles $\theta_1$ and $\theta_2$ are not equal to each other. In some embodiments, angles $\theta_1$ and $\theta_2$ are each equal to angle $\phi$ and, in other embodiments, angles $\theta_1$ and $\theta_2$ are not equal to angle $\phi$. It should be noted that the values for angles $\theta_1$ and $\theta_2$ are not shown to scale in FIG. 7*e*.

In general, angles $\theta_1$ and $\theta_2$ are chosen to reduce the likelihood that rotary earth bit 102 and adapter sub 136 will over-tighten with each other. Further, angles $\theta_1$ and $\theta_2$ are chosen to increase the efficiency in which overstrike force F is transferred from hammer assembly 103 to rotary earth bit 102 through adapter sub 136. In general, the efficiency in which overstrike force F is transferred from hammer assembly 103 to rotary earth bit 102 through adapter sub 136 increases and decreases as angles $\theta_1$ and $\theta_2$ decrease and increase, respectively. It should be noted that angles $\theta_1$, $\theta_2$, $\theta_3$ and $\theta_4$ generally have the same magnitude angular value to facilitate the ability to repeatably move adapter sub 136 and rotary earth bit 102 between coupled and decoupled conditions.

It should also be noted that the helix angle of trapezoidal tool joint threads 143 can have many different angular values. In some embodiments, the helix angle of trapezoidal tool joint threads 143 is in a range between about one degree (1°) to about ten degrees (10°). In some embodiments, the helix angle of trapezoidal tool joint threads 143 is in a range between about one and one-half degrees (1.5°) to about five degrees (5°) In one particular embodiment, the helix angle of trapezoidal tool joint threads 143 is about two and one-half degrees (2.5°). It should be noted that the helix angle of trapezoidal tool joint threads 143 and trapezoidal rotary earth bit threads 144 are generally the same to facilitate the ability to repeatably move adapter sub 136 and rotary earth bit 102 between coupled and decoupled conditions.

Figure 8A:
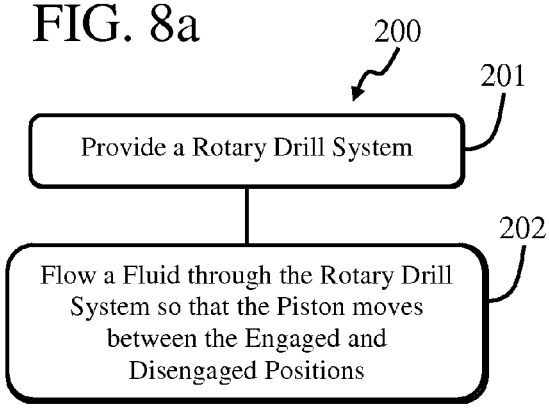
FIGS. 8*a* and 8*b* are flow diagrams of methods of boring a hole.

FIG. 8*a* is a flow diagram of a method 200, in accordance with the invention, of boring a hole. In this embodiment, method 200 includes a step 201 of providing a rotary drill system, wherein the rotary drill system includes a drive chuck and adapter sub slidingly engaged together, a rotary earth bit coupled to the adapter sub, and a piston repeatably moveable between engaged and disengaged positions with the adapter sub. The adapter sub slides relative to the drive chuck in response to the piston moving between the disengaged and engaged positions.

Method 200 includes a step 202 of flowing a fluid through the rotary drill system so that the piston moves between the engaged and disengaged positions. In this way, the piston moves between the engaged and disengaged positions in response to being actuated by a fluid. The rotary earth bit moves between extended and retracted positions in response to the piston moving between the engaged and disengaged positions.

Figure 8B:
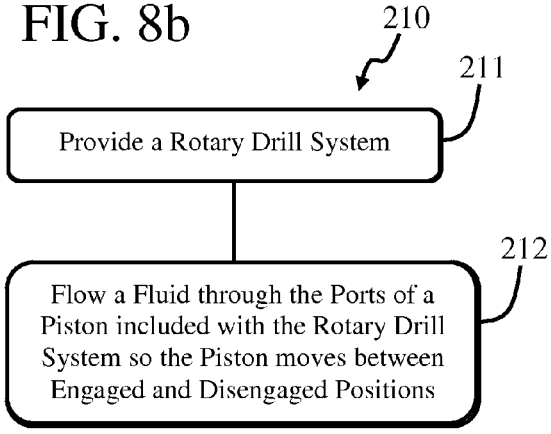

FIG. 8*b* is a flow diagram of a method 210, in accordance with the invention, of boring a hole. In this embodiment, method 210 includes a step 211 of providing a rotary drill system, wherein the rotary drill system includes a drive chuck and adapter sub slidingly engaged together, a rotary earth bit coupled to the adapter sub, and a piston repeatably moveable between engaged and disengaged positions with the adapter sub. The adapter sub slides relative to the drive chuck in response to the piston moving between the disengaged and engaged positions.

In this embodiment, the piston includes a return piston port positioned away from the adapter sub and a drive piston port positioned proximate to the adapter sub. Further, the rotary drill system can include a flow control tube with a return guide port and a drive guide port. The return guide port is repeatably moveable between a first position in communication with the return piston port and a second position not in communication with the return piston port. Further, the drive guide port is repeatably moveable between a first position in communication with the drive piston port and a second position not in communication with the drive piston port.

Method 210 includes a step 212 of flowing a fluid through the ports of the piston so it moves between the engaged and disengaged positions. In this way, the piston moves between the engaged and disengaged positions in response to being actuated by a fluid. The rotary earth bit moves between extended and retracted positions in response to the piston moving between the engaged and disengaged positions.

Figure 8C:
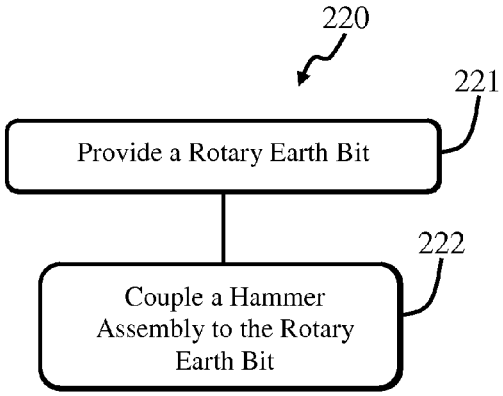
FIGS. 8*c* and 8*d* are flow diagrams of methods of manufacturing a rotary drill system.

FIG. 8*c* is a flow diagram of a method 220, in accordance with the invention, of manufacturing a rotary drill system. In this embodiment, method 220 includes a step 221 of providing a rotary earth bit and a step 222 of coupling a hammer assembly to the rotary earth bit. In accordance with the invention, the hammer assembly includes a drive chuck and adapter sub slidingly engaged together, and a piston repeatably moveable between engaged and disengaged positions with the adapter sub. The adapter sub slides relative to the drive chuck in response to the piston moving between the disengaged and engaged positions. The rotary earth bit is coupled to the adapter sub so that it slides in response to the adapter sub sliding.

A drill string is coupled to the hammer assembly and flows a fluid therethrough. The piston moves between the engaged and disengaged positions in response to the flow of the fluid. In this way, the piston moves between the engaged and disengaged positions in response to being actuated with a fluid. Further, the rotary earth bit moves between extended and retracted positions in response to the piston moving between the engaged and disengaged positions.

Figure 8D:
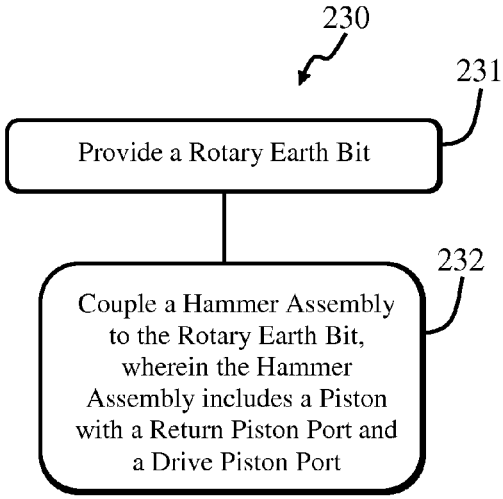

FIG. 8*d* is a flow diagram of a method 230, in accordance with the invention, of manufacturing a rotary drill system. In this embodiment, method 230 includes a step 231 of providing a rotary earth bit and a step 232 of coupling a hammer assembly to the rotary earth bit. In this embodiment, the hammer assembly includes a drive chuck and adapter sub slidingly engaged together and a piston repeatably moveable between engaged and disengaged positions with the adapter sub. The adapter sub slides relative to the drive chuck in response to the piston moving between the disengaged and engaged positions.

In this embodiment, the piston includes a drive piston port positioned away from the adapter sub and a drive piston port positioned proximate to the adapter sub. Further, the rotary drill system can include a flow control tube with a return guide port and a drive guide port. The return guide port is repeatably moveable between a first position in communication with the return piston port and a second position not in communication with the return piston port. Further, the drive guide port is repeatably moveable between a first position in communication with the drive piston port and a second position not in communication with the drive piston port.

In operation, the piston moves between the engaged and disengaged positions in response to a fluid flowing through the rotary drill system. In this way, the piston moves between the engaged and disengaged positions in response to being actuated by a fluid. The rotary earth bit moves between extended and retracted positions in response to the piston moving between the engaged and disengaged positions.

It should be noted that method 200 can include many other steps, several of which are discussed in more detail with method 210. Further, method 220 can include many other steps, several of which are discussed in more detail with method 230. Also, it should be noted that the steps in methods 200, 210, 220 and 230 can be performed in many different orders.

Figure 9A:
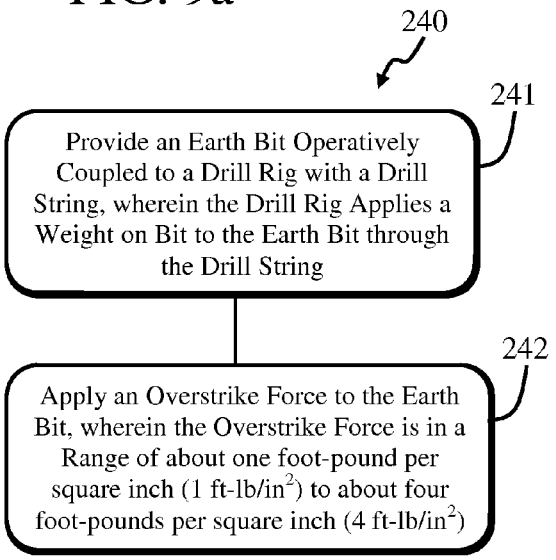
FIGS. 9*a*, 9*b* and 9*c* are flow diagrams of methods of boring through a formation.

FIG. 9*a* is a flow diagram of a method 240, in accordance with the invention, of boring through a formation. In this embodiment, method 240 includes a step 241 of providing an earth bit operatively coupled to a drilling machine with a drill string, wherein the drilling machine applies a weight-on-bit to the earth bit through the drill string. Method 240 includes a step 242 of applying an overstrike force to the earth bit, wherein the overstrike force is in a range of about one foot-pound per square inch (1 ft-lb/in$^2$) to about four foot-pounds per square inch (4 ft-lb/in$^2$).

The weight-on-bit can be in many different ranges. For example, in one embodiment, the weight-on-bit is in a range of about 1,000 pounds per inch of hole diameter to about 10,000 pounds per square inch of hole diameter. The overstrike force can be applied to the earth bit in many different ways. For example, in some embodiments, the overstrike force is applied to the earth bit with a hammer assembly. In these embodiments, the hammer assembly operates in response to a flow of fluid through the drill string.

It should be noted that method 240 can include many other steps. For example, in some embodiments, method 240 includes a step of applying the overstrike force to the earth bit at a rate in a range of about 1100 times per minute to about 1400 times per minute. In some embodiments, method can include a step of adjusting the overstrike force in response to adjusting a fluid flow through the drill string. Method 240 can include a step of adjusting an amplitude and/or frequency of the overstrike force in response to an indication of a penetration rate of the earth bit through the formation. Method 240 can include a step of providing an air flow through the drill string at a rate in a range of about 1,000 cubic feet per minute (cfm) to about 4,000 cubic feet per minute (cfm). Method 240 can include a step of providing an air flow through the drill string at a pressure in a range of about forty pounds per square inch (40 psi) to about eighty pounds per square inch (80 psi).

Figure 9B:
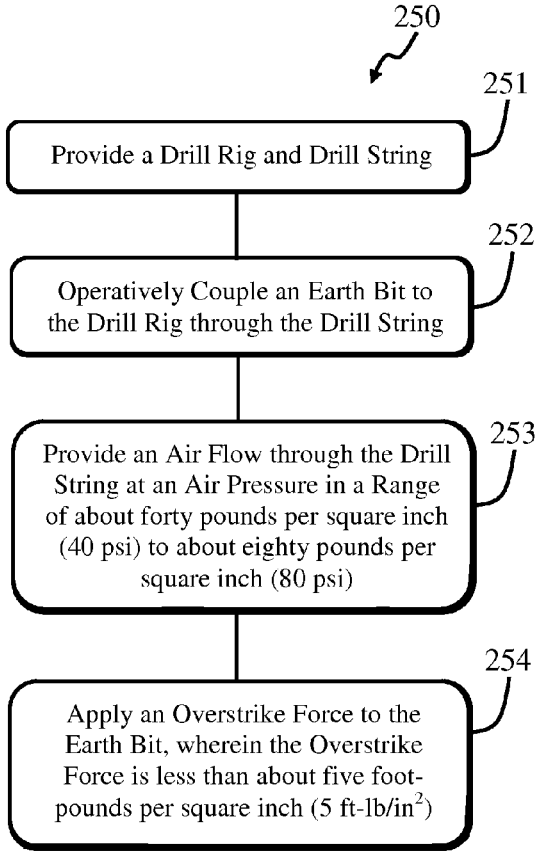

FIG. 9*b* is a flow diagram of a method 250, in accordance with the invention, of boring through a formation. In this embodiment, method 250 includes a step 251 of providing a drilling machine and drill string and a step 252 of operatively coupling an earth bit to the drilling machine through the drill string. Method 250 includes a step 253 of providing an air flow through the drill string at an air pressure in a range of about forty pounds per square inch (40 psi) to about eighty pounds per square inch (80 psi) and a step 254 of applying an overstrike force to the earth bit, wherein the overstrike force is less than about five foot-pounds per square inch (5 ft-lb/in$^2$).

The overstrike force can be in many different ranges. For example, in one embodiment, the overstrike force is in a range of about 1 ft-lb/in$^2$ to about 4 ft-lb/in$^2$.

It should be noted that method 250 can include many other steps. For example, in some embodiments, method 250 includes a step of adjusting the overstrike force in response to an indication of a penetration rate of the earth bit through the formation. In some embodiments, method 250 includes a step of adjusting the overstrike force to drive the penetration rate of the earth bit through the formation to a desired penetration rate. Method 250 can include a step of adjusting the penetration rate of the earth bit through the formation by adjusting at least one of an amplitude and frequency of the overstrike force. Method 250 can include a step of applying a weight-on-bit to the earth bit through the drill string, wherein the weight-on-bit is in a range of about 30,000 pounds to about 130,000 pounds.

Figure 9C:
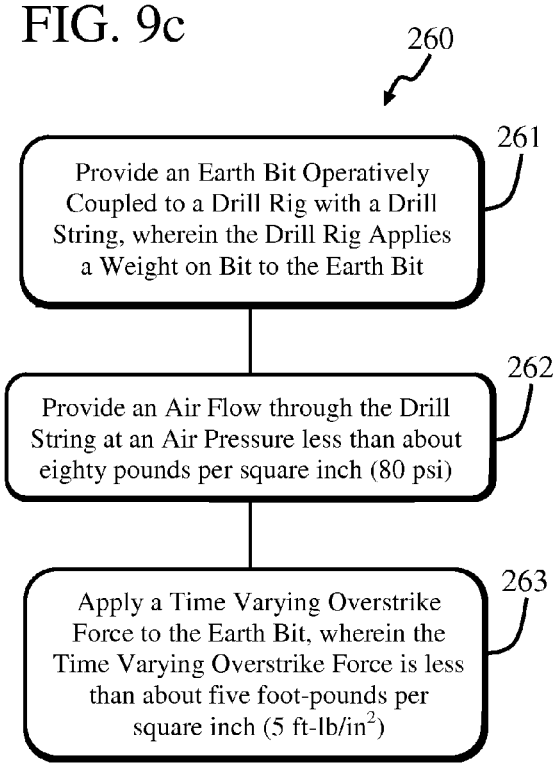

FIG. 9*c* is a flow diagram of a method 260, in accordance with the invention, of boring through a formation. In this embodiment, method 260 includes a step 261 of providing an earth bit operatively coupled to a drilling machine with a drill string, wherein the drilling machine applies a weight-on-bit to the earth bit and a step 262 of providing an air flow through the drill string at an air pressure less than about eighty pounds per square inch (80 psi). Method 260 includes a step 263 of applying a time varying overstrike force to the earth bit, wherein the time varying overstrike force is less than about five foot-pounds per square inch (5 ft-lb/in$^2$). The time varying overstrike force can have many different values. For example, in one embodiment, the time varying overstrike force is in a range of about 1.2 ft-lb/in$^2$ to about 3.6 ft-lb/in$^2$.

The time varying overstrike force can be applied to the earth bit in many different ways. For example, in some embodiments, the time varying overstrike force is applied to the earth with a hammer assembly.

It should be noted that method 260 can include many other steps. For example, in some embodiments, method 260 includes a step of adjusting an amplitude of the time varying overstrike force in response to an indication of a penetration rate of the earth bit through the formation. In some embodiments, method 260 includes adjusting a frequency of the time varying overstrike force in response to an indication of a penetration rate of the earth bit through the formation.

While particular embodiments of the invention have been shown and described, numerous variations and alternate embodiments will occur to those skilled in the art. Accordingly, it is intended that the invention be limited only in terms of the appended claims.

The invention claimed is:

1. A method of boring through a formation, comprising:

operatively coupling an earth bit to a rotary head through a drill string, wherein the rotary head applies a weight-on-bit to the earth bit through the drill string; and applying an overstrike force to the earth bit, wherein the overstrike force is in a range of about one foot pound per square inch (1 ft-lb/in$^2$) to about five foot pounds per square inch (5 ft-lb/in$^2$).

2. The method of claim 1, further including applying the overstrike force to the earth bit at a rate in a range of about eleven-hundred (1100) times per minute to about fourteen-hundred (1400) times per minute.

3. The method of claim 1, further including adjusting the overstrike force in response to adjusting a fluid flow through the drill string.

4. The method of claim 3, further including adjusting an amplitude and/or frequency of the overstrike force in response to an indication of a penetration rate of the earth bit through the formation.

5. The method of claim 1, further including providing an air flow through the drill string at a rate in a range of about one-thousand cubic feet per minute (1,000 cfm) to about four thousand cubic feet per minute (4,000 cfm).

6. The method of claim 1, further including providing an air flow through the drill string at a pressure less than about one-hundred pounds per square inch (100 psi).

7. The method of claim 1, wherein the weight-on-bit is in a range of about one-thousand (1,000) pounds per square inch of hole diameter to about ten-thousand (10,000) pounds per square inch of hole diameter.

8. The method of claim 1, wherein the overstrike force is applied to the earth bit with a hammer assembly.

9. The method of claim 8, wherein the hammer assembly operates in response to a flow of fluid through the drill string.

10. A method of boring through a formation, comprising:

providing a drilling machine and drill string;

operatively coupling an earth bit to the drilling machine through the drill string;

providing an air flow through the drill string at an air pressure less than about one-hundred pounds per square inch (100 psi);

providing an air flow through the drill string at a rate in a range of about one-thousand cubic feet per minute (1,000 cfm) to about four-thousand cubic feet per minute (4,000 cfm); and applying an overstrike force in a range of about one pound per square inch (1 psi) to about four pounds per square inch (4 psi).

11. The method of claim 10, further including adjusting the overstrike force in response to an indication of a penetration rate of the earth bit through the formation.

12. The method of claim 10, further including adjusting the overstrike force to achieve a desired penetration rate.

13. The method of claim 10, further including adjusting the penetration rate of the earth bit through the formation by adjusting at least one of an amplitude and a frequency of the overstrike force.

14. The method of claim 10, further including applying a weight-on-bit to the earth bit through the drill string, wherein the weight-on-bit is in a range of about thirty thousand pounds (30,000 lbs) to about one-hundred and thirty thousand pounds (130,000 lbs).

15. A method of boring through a formation, comprising:

operatively coupling an earth bit to a rotary head with a drill string, wherein the rotary head applies a weight-on-bit to the earth bit;

providing an air flow through the drill string at an air pressure between about forty pounds per square inch (40 psi) to about one-hundred pounds per square inch (100 psi);

providing an air flow through the drill string at a rate in a range of about one-thousand cubic feet per minute (1,000 cfm) to about four-thousand cubic feet per minute (4,000 cfm); and applying a time varying overstrike force to the earth bit, wherein the time varying overstrike force is applied with a force that is less than about five pounds per square inch (5 psi) and a frequency that is less than about fifteen hundred (1500) times per minute.

16. The method of claim 15, wherein the time varying overstrike force is applied to the earth bit with a hammer assembly.

17. The method of claim 15, further including adjusting an amplitude of the time varying overstrike force in response to an indication of a penetration rate of the earth bit through the formation.

18. The method of claim 15, further including adjusting a frequency of the time varying overstrike force in response to an indication of a penetration rate of the earth bit through the formation.

19. The method of claim 15, wherein the time varying overstrike force is in a range of about 1.2 pounds per square inch (1.2 psi) to about 3.6 pounds per square inch (3.6 psi).

* * * * *